US009291019B2

(12) United States Patent
Aphale et al.

(10) Patent No.: US 9,291,019 B2
(45) Date of Patent: Mar. 22, 2016

(54) SYSTEMS AND METHODS TO INHIBIT PACKOFF FORMATION DURING DRILLING ASSEMBLY REMOVAL FROM A WELLBORE

(71) Applicants: Chinar R. Aphale, Houston, TX (US); Pietro Valsecchi, Houston, TX (US); Jon M. Wallace, Houston, TX (US); Fuping Zhou, Sugar Land, TX (US)

(72) Inventors: Chinar R. Aphale, Houston, TX (US); Pietro Valsecchi, Houston, TX (US); Jon M. Wallace, Houston, TX (US); Fuping Zhou, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 647 days.

(21) Appl. No.: 13/717,164

(22) Filed: Dec. 17, 2012

(65) Prior Publication Data

US 2013/0153296 A1 Jun. 20, 2013

Related U.S. Application Data

(60) Provisional application No. 61/578,078, filed on Dec. 20, 2011.

(51) Int. Cl.

| | |
|---|---|
| ***E21B 21/00*** | (2006.01) |
| ***E21B 7/00*** | (2006.01) |
| ***E21B 31/03*** | (2006.01) |
| ***E21B 23/04*** | (2006.01) |
| ***E21B 41/00*** | (2006.01) |
| ***E21B 21/10*** | (2006.01) |
| *E21B 31/107* | (2006.01) |

(52) U.S. Cl.

CPC ..... *E21B 31/03* (2013.01); *E21B 21/00* (2013.01); *E21B 21/10* (2013.01); *E21B 23/04* (2013.01); *E21B 41/0078* (2013.01); *E21B 31/107* (2013.01)

(58) Field of Classification Search

CPC ..... E21B 21/00; E21B 37/00; E21B 41/0078; E21B 7/068; E21B 21/10; E21B 31/03; E21B 23/04; E21B 31/107

See application file for complete search history.

(56) References Cited

U.S. PATENT DOCUMENTS

| | | | |
|---|---|---|---|
| 2,833,517 | A | 5/1958 | Bobo |
| 4,373,582 | A | 2/1983 | Bednar et al. |
| 4,844,182 | A | 7/1989 | Tolle |
| 5,074,366 | A | 12/1991 | Karlsson et al. |
| 5,465,787 | A | 11/1995 | Roth |
| 5,730,222 | A | 3/1998 | Rike, Jr. |

(Continued)

FOREIGN PATENT DOCUMENTS

| | | |
|---|---|---|
| CA | 1 253 846 | 5/1989 |
| EP | 0 601 724 | 6/1994 |
| WO | WO 02/14649 A1 | 2/2002 |

*Primary Examiner* — Daniel P Stephenson

(74) *Attorney, Agent, or Firm* — ExxonMobil Upstream Research-Law Department

(57) ABSTRACT

Systems and methods to inhibit packoff during drilling assembly removal from a wellbore, utilizing a drilling assembly that includes a transition region between a first section having a first cross-sectional area and a second section having a second cross-sectional area, wherein the second cross-sectional area is greater than the first cross-sectional area. The transition region includes a fluidizing assembly configured to partially fluidize a portion of the cuttings bed that is proximal to the transition region, and/or be in fluid communication with a flow control assembly configured to control flow rate of a fluidizing stream from the fluidizing assembly and to the portion of cuttings bed.

18 Claims, 8 Drawing Sheets

(56) References Cited

U.S. PATENT DOCUMENTS

| | | | | |
|---|---|---|---|---|
| 5,979,572 | A | 11/1999 | Boyd et al. | |
| 5,984,011 | A | 11/1999 | Misselbrook et al. | |
| 6,290,001 | B1 | 9/2001 | West et al. | |
| 6,446,737 | B1 | 9/2002 | Fontana et al. | |
| 6,607,607 | B2 * | 8/2003 | Walker | B08B 9/0433 134/166 C |
| 6,820,702 | B2 | 11/2004 | Niedermayr et al. | |
| 6,840,337 | B2 * | 1/2005 | Terry | E21B 7/068 138/108 |
| 6,868,920 | B2 | 3/2005 | Hoteit et al. | |
| 6,988,551 | B2 | 1/2006 | Evans | |
| 7,003,439 | B2 | 2/2006 | Aldred et al. | |
| 7,066,251 | B2 | 6/2006 | Streater et al. | |
| 7,114,582 | B2 | 10/2006 | Eppink et al. | |
| 7,308,941 | B2 * | 12/2007 | Rolovic | E21B 47/10 166/222 |
| 7,653,563 | B2 | 1/2010 | Veeningen et al. | |
| 7,703,529 | B2 * | 4/2010 | Robinson | C09K 8/536 166/305.1 |
| 7,703,549 | B2 | 4/2010 | Krepp et al. | |
| 7,814,989 | B2 | 10/2010 | Nikolakis-Mouchas et al. | |
| 7,874,364 | B2 | 1/2011 | Redlinger et al. | |
| 8,151,910 | B2 | 4/2012 | Swinford | |
| 2005/0009249 | A1 | 1/2005 | Oh et al. | |
| 2008/0060846 | A1 | 3/2008 | Belcher et al. | |
| 2009/0133883 | A1 | 5/2009 | Baird | |
| 2009/0145661 | A1 | 6/2009 | Jeffryes et al. | |
| 2009/0277690 | A1 | 11/2009 | Swinford | |
| 2010/0235101 | A1 | 9/2010 | Aamodt et al. | |
| 2010/0294569 | A1 * | 11/2010 | Aldred | E21B 4/04 175/65 |
| 2010/0314174 | A1 | 12/2010 | Denoix et al. | |
| 2011/0266066 | A1 | 11/2011 | Viel et al. | |
| 2011/0284233 | A1 | 11/2011 | Wu et al. | |
| 2011/0297380 | A1 | 12/2011 | Alberty et al. | |
| 2012/0059521 | A1 | 3/2012 | Iversen et al. | |

* cited by examiner

SYSTEMS AND METHODS TO INHIBIT PACKOFF FORMATION DURING DRILLING ASSEMBLY REMOVAL FROM A WELLBORE

CROSS REFERENCE TO RELATED APPLICATIONS

This application claims the benefit of U.S. Provisional Application 61/578,078, filed Dec. 20, 2011.

FIELD OF THE DISCLOSURE

The present disclosure is directed generally to systems and methods to inhibit packoff events when a drilling assembly is removed from a wellbore and more specifically to systems and methods that utilize a fluidizing assembly to fluidize a portion of a cuttings bed that is proximal to a transition region of the drilling assembly.

BACKGROUND OF THE DISCLOSURE

The production of fluids from subterranean formations may include the use of subterranean wells to transport the fluids from the subterranean formation to a surface region and/or to provide stimulant fluids to the subterranean formation. These subterranean wells may be created using a drilling assembly to drill, or create, a wellbore, which may form a portion of the subterranean well. Drilling assemblies may include a plurality of portions, regions, components, parts, segments, and/or sections, each of which may serve a specific purpose during creation of the wellbore. These sections may include a cross-sectional area, and this cross-sectional area may vary from section to section and/or within sections.

As an illustrative, non-exclusive example, the drilling assembly may include a drill pipe and a bottom-hole assembly. The drill pipe typically will form a mechanical and fluid connection between the surface region and the bottom-hole assembly, a portion of which may be located at a terminal end of the drilling assembly. In addition, a cross-sectional area and/or a diameter of the drill pipe may be less than a cross-sectional area and/or diameter of the bottom-hole assembly.

The bottom-hole assembly, which may include a drill bit, may be in mechanical contact with a terminal end of the wellbore. During the drilling process, the drill bit may remove material, which may be referred to herein as cuttings, from the terminal end of the wellbore to increase a length of the wellbore. The drilling assembly may include and/or be a fluid conduit that is configured to provide a drilling fluid stream to the wellbore, such as to the terminal end thereof, via the bottom-hole assembly. The drilling fluid stream may lubricate at least a portion of the bottom-hole assembly, cool at least a portion of the bottom-hole assembly, and/or provide a motive force for removal of at least a portion of the cuttings from the wellbore by flowing the cuttings to the surface region.

However, a portion of the cuttings may remain within the wellbore. These cuttings may settle and/or otherwise accumulate and may produce a cuttings bed on and/or near a bottom surface of the wellbore. The size, or extent, of this cuttings bed, or, alternatively, a fraction of the cuttings that remain within the wellbore to form the cuttings bed, may vary with a variety of factors. Illustrative, non-exclusive examples of such factors may include a flow rate of the drilling fluid stream, a diameter of the wellbore, a diameter of the drilling assembly, a size of the cuttings, a density of the cuttings, a viscosity of the drilling fluid, and/or an orientation of the wellbore.

As an illustrative, non-exclusive example, a horizontal, or substantially horizontal, or highly inclined wellbore may include a larger cuttings bed than a vertical, or substantially vertical, wellbore. This may be caused, at least in part, by a tendency for the cuttings to settle under the influence of gravity to the bottom, or other horizontal, or substantially horizontal, or highly inclined surface of the wellbore and/or a tendency for the drilling fluid to flow, or channel, near an upper surface of the wellbore. As another illustrative, non-exclusive example, a wellbore that includes a breakout region, wherein a cross-sectional area of the wellbore is greater than a nominal cross-sectional area of the wellbore, may include a larger cuttings bed in the vicinity of the breakout region. This may be caused by a decrease in the flow rate of the cuttings fluid stream within the breakout region due to larger cross-sectional area of the wellbore in the breakout region.

During and/or after completion of the drilling process, at least a portion of the drilling assembly may be withdrawn from, drawn out of, pulled from, taken out of, and/or otherwise removed from the wellbore. This removal may include drawing, or pulling, the drilling assembly within the wellbore and along a longitudinal axis of the drilling assembly toward the surface region. In conjunction with pulling, the drilling assembly may be rotated and/or drilling fluid may be circulated through the drill bit and up the annulus. Removal of the drilling assembly from the wellbore may push, move, and/or otherwise collect at least a portion of the cuttings bed present within the wellbore, leading to the formation of a cuttings dune. As an illustrative, non-exclusive example, a transition region between a first section of the drilling assembly, which includes a first cross-sectional area, and a second section of the drilling assembly, which includes a second cross-sectional area that is larger than the first cross-sectional area, may facilitate, or otherwise contribute to, formation of the cuttings dune.

Under certain circumstances, the cuttings dune may cause a packoff, which may preclude further removal of the drilling assembly from the wellbore. The formation or occurrence of a packoff (including a packoff or a packoff-related event) may result in abandonment of at least a portion of the wellbore, require drilling a new section of the wellbore adjacent to the packoff location, and/or result in abandonment of the bottom whole assembly in the packoff region of the wellbore, any of which may substantially increase the costs associated with and/or time needed to complete the drilling operation.

SUMMARY OF THE DISCLOSURE

Systems and methods to inhibit, prevent, or alleviate packoff formation or creation or occurrence of a packoff-related event during drilling during drilling operations such as during drilling assembly (including drill pipe, drill collars, drilling-related down-hole tools, bits, and or combinations or portions thereof) removal from a wellbore. For simplicity herein, each and all of such events and related matters are referred to herein generally as a "packoff." These systems and methods may include utilizing a drilling assembly that includes a transition region between a first section having a first cross-sectional area and a second section having a second cross-sectional area, wherein the second cross-sectional area is greater than the first cross-sectional area. The transition region may include a fluidizing assembly configured to at least partially fluidize a portion of the cuttings bed that is proximal to the transition region. The fluidizing assembly may include and/or be in fluid communication with a flow control assembly configured to control a flow rate of a fluidizing stream that may be provided from the fluidizing assembly and to the portion of the cuttings bed.

In some embodiments, the fluidizing assembly may be configured to provide the fluidizing stream to the portion of the cuttings bed while the drilling assembly is being removed from the wellbore. In some embodiments, the drilling assembly may be configured to control an orientation, or relative orientation, of at least a portion of the fluidizing assembly and/or to selectively provide the fluidizing stream to the portion of the cuttings bed. In some embodiments, the fluidizing assembly may include one or more fluid orifices. In some embodiments, the one or more fluid orifices may include one or more diffusers.

In some embodiments, the drilling assembly may form a portion of a drill rig. In some embodiments the drill rig may include a mechanical drive assembly in mechanical communication with the drilling assembly. In some embodiments, the drill rig may include a fluid supply assembly in fluid communication with a fluid conduit that is formed by the drilling assembly. In some embodiments, the drill rig may include a controller configured to control the operation of the drilling assembly. In some embodiments, the controller may be configured to control a flow rate of the fluidizing stream based, at least in part, on a variable associated with the drilling assembly.

DETAILED DESCRIPTION AND BEST MODE OF THE DISCLOSURE

Figure 1:
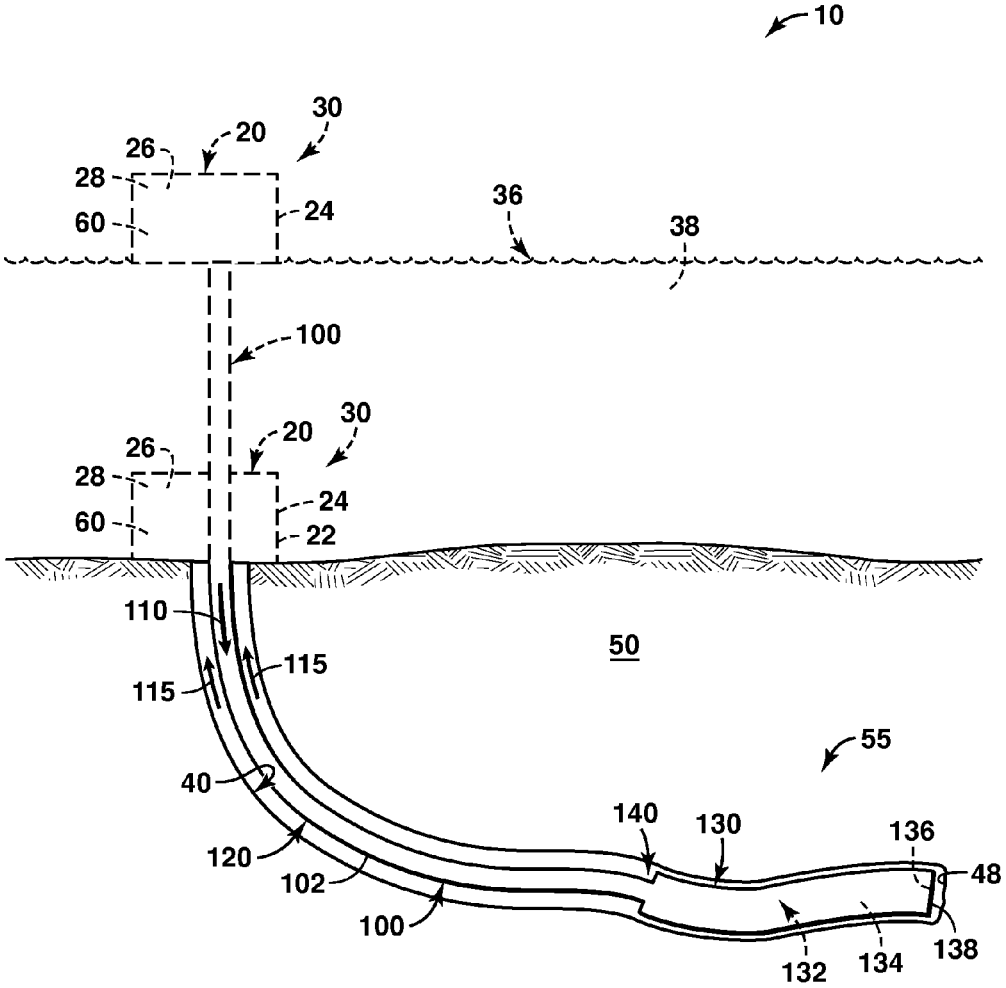
FIG. 1 is a schematic representation of illustrative, non-exclusive examples of a wellbore drilling operation that may utilize the systems and methods according to the present disclosure.

FIG. 1 provides a schematic representation of illustrative, non-exclusive examples of a wellbore drilling operation 10 that may utilize the systems and methods according to the present disclosure. In FIG. 1, a drill rig 20, which may include a land-based drill rig 22 that is located in a surface region 30 and/or a water-based drill rig 24 that may be located above and/or beneath a surface 36 of a body of water 38, is in mechanical and fluid communication with a drilling assembly 100. Drilling assembly 100 is configured to form, create, and/or drill a wellbore 40 within a subsurface region 50 that may include a subterranean formation 55. When subterranean formation 55 includes a hydrocarbon, wellbore 40 may form a portion of a hydrocarbon well.

Drill rig 20 may include any suitable structure that is configured to utilize drilling assembly 100 during the formation of wellbore 40, to insert drilling assembly 100 into wellbore 40, and/or to remove the drilling assembly from the wellbore. As an illustrative, non-exclusive example, drill rig 20 may include and/or be in communication with a mechanical drive assembly 26 that is configured to insert drilling assembly 100 into wellbore 40, remove drilling assembly 100 from wellbore 40, and/or rotate drilling assembly 100 around a longitudinal axis thereof while the drilling assembly is within the wellbore.

As another illustrative, non-exclusive example, drill rig 20 may include and/or be in communication with a fluid supply assembly 28 that is configured to provide a drilling fluid stream 110 to drilling assembly 100. Drilling fluid stream 110 may include any suitable fluid that is configured to facilitate insertion of drilling assembly 100 into wellbore 40, removal of drilling assembly 100 from wellbore 40, and/or lengthening of wellbore 40 with drilling assembly 100. Illustrative, non-exclusive examples of drilling fluid streams 110 according to the present disclosure include drilling fluid streams that include and/or contain drilling mud, water, water-based mud, oil-based mud, oil, clay, a viscosity-control additive, a stability-enhancing additive, a coolant, a lubricant, and/or a pack-off-inhibiting additive.

Drilling assembly 100 includes a plurality of sections. In the depicted illustrative, non-exclusive examples of FIG. 1, the plurality of sections include at least a first section 120 and a second section 130 that may include and/or comprise a fluid conduit 102 that is configured to transmit drilling fluid stream 110 there through. A size, length, diameter, and/or cross-sectional area of first section 120 may be different from a size, length, diameter, and/or cross-sectional area of second section 130. Thus, a transition region 140 may be present between first section 120 and second section 130. Second section 130 may include any suitable length, and thus transition region 140 may be any suitable distance from a terminal end 138 of the drilling assembly. As illustrative, non-exclusive examples, transition region 140 may be at least 5 meters, at least 10 meters, at least 15 meters, at least 20 meters, at least 25 meters, at least 30 meters, at least 40 meters, or at least 50 meters from the terminal end of the drilling assembly.

As an illustrative, non-exclusive example, the cross-sectional area and/or another characteristic dimension of first section 120 may be less than the cross-sectional area and/or another characteristic dimension of second section 130. Illustrative, non-exclusive examples of characteristic dimensions according to the present disclosure include any suitable area, cross-sectional area, length, width, height, radius, diameter, and/or effective diameter. The characteristic dimension may be measured in any suitable relative direction, an illustrative, non-exclusive example of which includes a direction that is transverse to the longitudinal axis of drilling assembly 100 at the point where the characteristic dimension is measured. Illustrative, non-exclusive examples of effective diameters include the diameter of a circular cross-sectional shape and/or the diameter of a circle that has the same cross-sectional area as the cross-sectional area of the first section and/or the second section at the point of interest.

First section 120 may be and/or include any suitable structure that is configured to provide a mechanical and fluid connection between (1) drill rig 20 and/or surface region 30 and (2) second section 130. Illustrative, non-exclusive examples of first section 120 according to the present disclosure include drill pipe and/or a drill string. Similarly, second section 130 may be and/or include any suitable structure that may form a portion of drilling assembly 100. Illustrative, non-exclusive examples of second section 130 according to the present disclosure include a bottom-hole assembly 132, a drill collar 134, and/or a drill bit 136. Drilling assembly 100, first section 120, and/or second section 130 also may include additional structures, illustrative, non-exclusive examples of which include stabilizers, jars, down-hole logging tools, and/or one or more components of a rotary steerable system.

Drill bit 136 may be present at terminal end 138 of drilling assembly 100 and/or second section 130 and may be configured to contact terminal end 48 of wellbore 40, such as to produce cuttings and increase the length of the wellbore in a drilling process. During the drilling process, drill rig 20 may provide at least a portion of drilling fluid stream 110 to terminal end 138 of drilling assembly 100. The drilling fluid stream may cool and/or lubricate at least a portion of the drilling assembly to provide a motive force for drill bit 136, and/or provide a motive force for the transport of at least a portion of the cuttings produced during the drilling process in an upstream direction and/or toward surface region 30. This may include entraining the cuttings within a return stream 115 of the drilling fluid that may flow from drilling assembly 100, such as from terminal end 138 thereof, toward surface region 30.

A flow of fluid, such as drilling fluid, and/or a motion of systems and/or assemblies, such as drilling assembly 100, within wellbore 40 may be described as being in an upstream direction, in a downstream direction, and/or in a rotary direction, such as when drilling assembly 100 may rotate about a longitudinal axis thereof within wellbore 40. The upstream direction additionally or alternatively may be described as being toward surface region 30. The downstream direction additionally or alternatively may be described as being toward terminal end 138 of drilling assembly 100 and/or terminal end 48 of wellbore 40.

As an illustrative, non-exclusive example, withdrawing drilling assembly 100 from wellbore 40 also may be described as moving at least a portion of the drilling assembly in an upstream direction, moving at least a portion of the drilling assembly toward surface region 30, and/or moving at least a portion of the drilling assembly away from terminal end 48 of wellbore 40. As another illustrative, non-exclusive example, inserting drilling assembly 100 into wellbore 40 also may be described as moving at least a portion of the drilling assembly in a downstream direction, moving at least a portion of the drilling assembly away from surface region 30, and/or moving at least a portion of the drilling assembly toward terminal end 48 of wellbore 40. As yet another illustrative, non-exclusive example, the drilling process may include rotating the drilling assembly within the wellbore while simultaneously providing at least a portion of the drilling fluid stream to the terminal end of the drilling assembly, moving the drilling assembly in a downstream direction, and/or flowing cuttings produced by the drilling process in an upstream direction with return stream 115.

Drill rig 20 and/or drilling assembly 100 also may include and/or be in communication with a controller 60 that is configured to control the operation of the drilling assembly and/or drill rig 20. As discussed in more detail herein, controller 60 may be configured to detect a variable associated with drilling assembly 100, subsurface region 50, and/or subterranean formation 55, and to control the operation of drill rig 20 and/or drilling assembly 100 based, at least in part, thereon.

Figure 2:
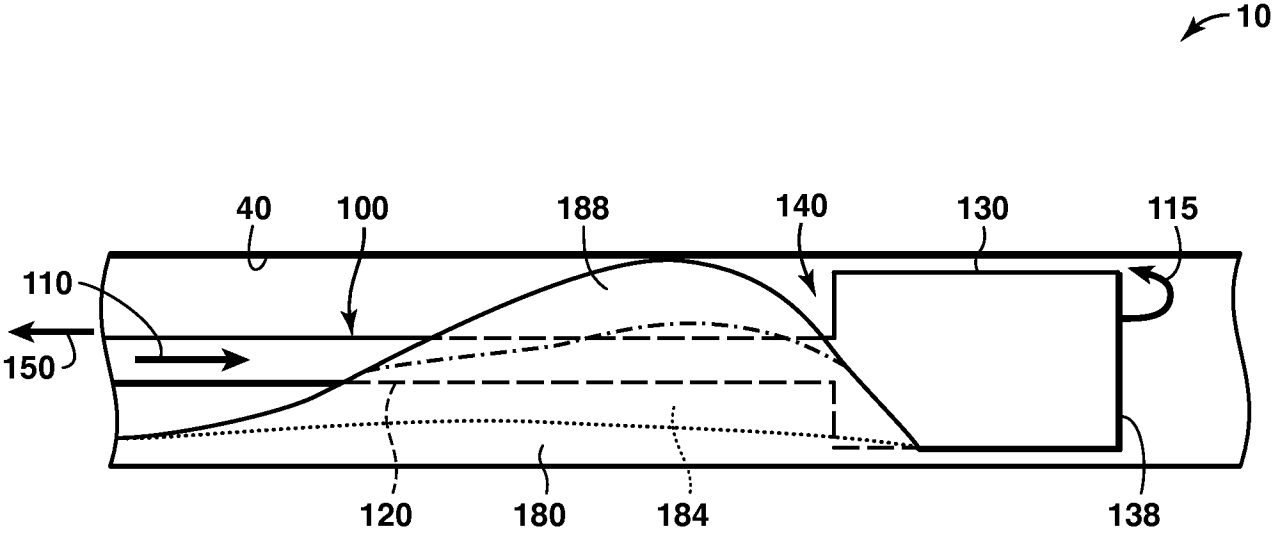
FIG. 2 is a schematic representation of illustrative, non-exclusive examples of a portion of a drilling assembly being removed from a wellbore.

FIG. 2 provides a schematic representation of illustrative, non-exclusive examples of drilling assembly 100 being removed from wellbore 40. As discussed in more detail herein, the drilling assembly includes transition region 140 between first section 120, which has a first cross-sectional area, and second section 130, which has a second cross-sectional area that is greater than the first cross-sectional area. In FIG. 2, the drilling assembly is depicted being withdrawn from wellbore 40 in withdrawal direction 150.

Initially, and as shown in dotted lines in FIG. 2, a cuttings bed 180 may be present on a bottom surface of at least a portion of wellbore 40. However, and as shown in dash-dot lines in FIG. 2, the motion of drilling assembly 100 within wellbore 40 may lead to the formation of a cuttings dune, aggregation, or buildup of cuttings 184 on an upstream side of transition region 140. Under certain circumstances, and as shown as a solid line in FIG. 2, the cuttings dune 184 may cause a packoff 188, which may obstruct or otherwise preclude, or prevent, further motion of drilling assembly 100 in withdrawal direction 150 within wellbore 40.

Conventionally, drilling fluid stream 110 may be provided to terminal end 138 of drilling assembly 100 when the drilling assembly is being removed from wellbore 40. However, and as shown in FIG. 2, the presence of a large cuttings dune and/or the occurrence of packoff within the wellbore may direct, or otherwise divert, a substantial portion, a majority, and/or all of return stream 115 that is produced from drilling fluid stream 110 along a top surface and/or in an upper region of wellbore 40, thereby decreasing the effectiveness of the return stream in removing cuttings from the wellbore, especially in the region of the cuttings dune and/or packoff.

However, it is also within the scope of the present disclosure that the drilling fluid stream may not be provided to terminal end 138 of the drilling assembly and/or may be intermittently provided to the terminal end of the drilling assembly when the drilling assembly is being removed from the wellbore. As an illustrative, non-exclusive example, drilling fluid stream 110 may be provided to the terminal end of the drilling assembly during removal of the drilling assembly from the wellbore responsive to formation of cuttings dune 184 within the wellbore and/or the occurrence of packoff 188.

Transition region 140 may include any suitable structure that is configured to connect, operatively attach, and/or adapt first section 120 to second section 130. Illustrative, non-exclusive examples of transition regions 140 according to the present disclosure include any suitable coupling and/or threaded connection. Similarly, transition region 140 may include any suitable shape. As an illustrative, non-exclusive example, and as shown in FIG. 2, when first section 120 includes a cross-sectional area that is less than a cross-sectional area of second section 130, transition region 140 may include an abrupt, or stepped, transition between the first section and the second section. As another illustrative, non-exclusive example, transition region 140 also may include a gradual, staged, and/or tapered transition between first section 120 and second section 130.

When first section 120 includes a different cross-sectional area than second section 130, the cross-sectional area of second section 130 may be of any suitable magnitude relative to the cross-sectional area of first section 120. Illustrative, non-exclusive examples of ratios of the cross-sectional area of second section 130 to the cross-sectional area of first section 120 include ratios of at least 1.1:1, including ratios of at least 1.2:1, 1.3:1, 1.4:1, 1.5:1, 1.6:1, 1.7:1, 1.8:1, 1.9:1, 2:1, 2.25:1, 2.5:1, 3:1, 4:1, or at least 5:1, and further optionally including ratios of between 1.1:1 and 2:1, between 1.5:1 and 3:1, or between 1.5:1 and 5:1.

Figure 3:
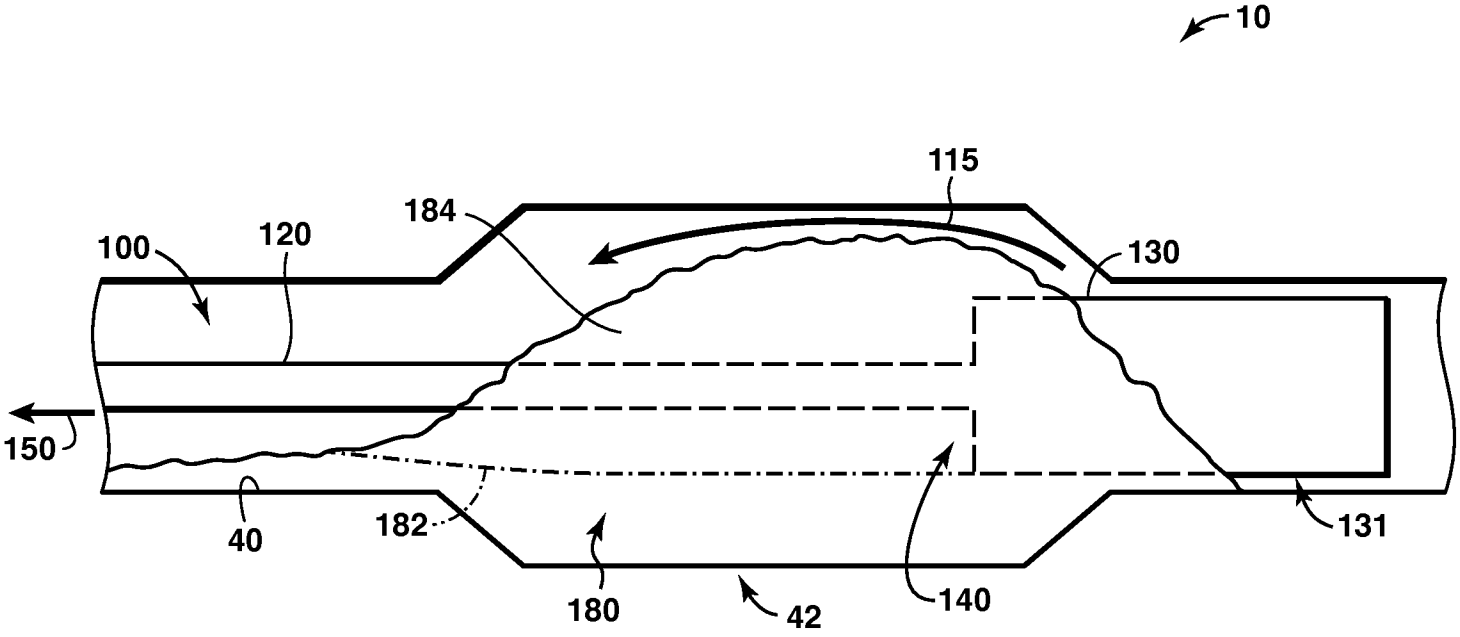
FIG. 3 is a schematic representation of an illustrative, non-exclusive example of a breakout region within a wellbore.

FIG. 3 provides a schematic representation of an illustrative, non-exclusive example of a breakout scenario in a wellbore. In FIG. 3, wellbore 40 includes breakout region 42, where a cross-sectional area of the wellbore may be larger than a nominal, designed, and/or desired cross-sectional area of the wellbore. When wellbore 40 includes breakout region 42, a velocity of return stream 115 within the breakout region may be less than a velocity of the return stream within a nominal-diameter wellbore, such as upstream or downstream of the breakout region. This may be due to the increased cross-sectional area of the annular region between the drilling assembly and the wellbore within the breakout region and may lead to deposition of cuttings within and/or proximal to the breakout region. This deposition, or accumulation, of cuttings in the breakout region may increase dune formation and increase a potential for packoff proximal to the breakout region.

Regardless of the presence or absence of breakout region 42 within wellbore 40, movement of transition region 140 through cuttings bed 180 in withdrawal direction 150 may lead to the formation of cuttings dune 184. When second section 130 is pulled through the cuttings bed, it may exert a compressive stress on the cuttings contained therein. A granular material, such as cuttings bed 180, that is subject to a compressive stress may experience shear failure along a surface of lowest shear strength 182, as schematically depicted in dash dot lines in FIG. 3. Failure and/or motion of cuttings bed 180 along the surface of lowest shear strength 182, which may tend to be parallel to a lower surface 131 of second section 130, may lead to the formation of cuttings dune 184 as drilling assembly 100 is moved through wellbore 40 and additional cuttings collect behind second section 130.

In a closely packed bed of solid particles, such as cuttings bed 180, fluid may occupy pore space between the solid particles. Under these conditions, the lubricating nature of the fluid may significantly decrease friction and/or resistance to motion among the particles. When a compressive stress is exerted on the cuttings bed by second section 130, it is balanced by an opposite stress that is applied to the second section by the cuttings bed. This bed stress may be described by:

$$\sigma_{total}=P_{fluid}+\sigma_{solid}$$

Where $\sigma_{total}$ is the total stress that is applied to the second section by the cuttings bed, $P_{fluid}$ is a pressure of the fluid that occupies the pore space between the solid particles, and $\sigma_{solid}$ is the solid-solid effective stress due to friction and/or resistance to motion among the cuttings particles that comprise the cuttings bed. Often, the pressure of the fluid that occupies the pore space is significantly less than the total stress. Under these conditions, the solid-solid effective stress may be large in order for the total stress to balance the stress that is applied to the cuttings bed by the second section. According to the simple Mohr Coulomb theory, this leads to a large shear stress required to move the cuttings bed resulting in a large resistance to motion.

Figure 4:
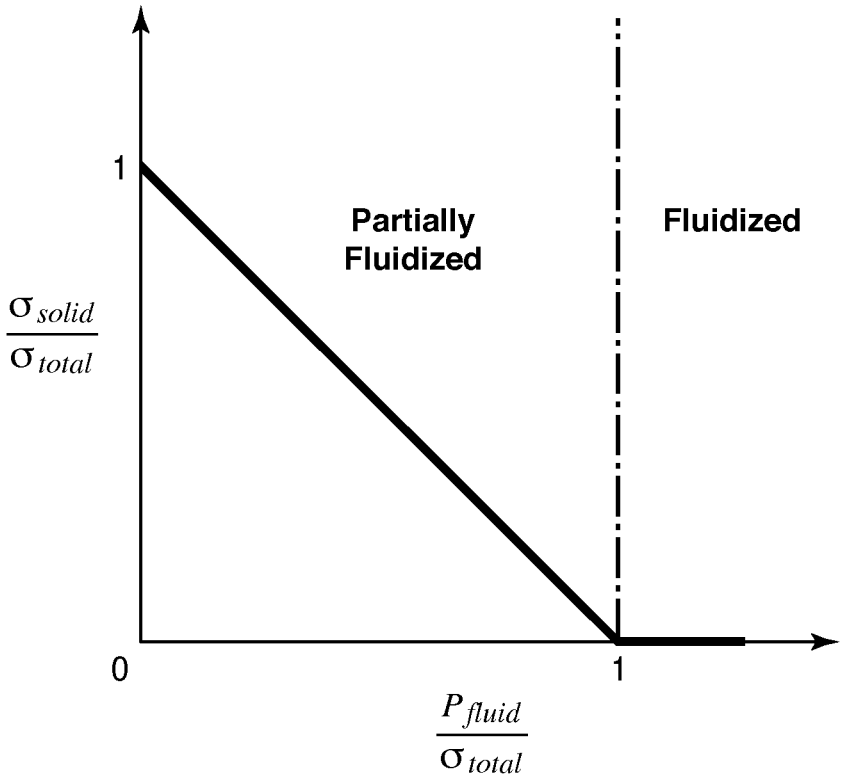
FIG. 4 is a graph depicting solid-solid shear stress as a function of fluid pressure.

However, by increasing the fluid pressure in the vicinity of the transition region between the first section and the second section, the solid-solid stress may be decreased and/or substantially eliminated. This is shown in FIG. 4, which is a schematic graph depicting solid-solid shear stress as a function of fluid pressure normalized by the total stress. FIG. 4 illustrates that, at low normalized fluid pressures, such as are shown on the left side of the graph, solid-solid stress is high, which may increase the likelihood of a packoff event by resisting the motion of the drilling assembly within the wellbore and/or increasing the rate of cuttings dune formation. However, as the fluid pressure is increased, solid-solid stress decreases substantially, eventually approaching zero as the fluid pressure approaches the total stress.

As shown in FIG. 4, a cuttings bed that includes a decreased solid-solid stress due to increased pore pressure may be referred to herein as being partially fluidized and/or as a partially fluidized cuttings bed. Similarly, a cuttings bed that includes a small, negligible, or substantially nonexistent solid-solid stress due to a pore pressure that is equal to and/or greater than the total applied stress may be referred to herein as being fluidized and/or as a fluidized cuttings bed. While a cuttings bed that includes substantial solid-solid stresses may, under certain circumstances, behave as a solid, a partially fluidized and/or a fluidized cuttings bed may behave (at least partially, or substantially) as a fluid. Under these conditions, resistance to the motion of the drilling assembly due to solid-solid interactions within the cuttings bed may be substantially decreased and/or eliminated, thereby decreasing a resistance to motion of the drilling assembly and decreasing a potential for packoff as the drilling assembly is removed from the wellbore.

In addition, while fluid jets or similar devices that emit fluid at high velocity might be utilized to displace at least a portion of the cuttings bed present within wellbore 40 in an upstream direction relative to a location of the second section, this displaced portion of the cuttings bed is still upstream from the second section and thus may cause a future packoff as the second section is removed from the wellbore. In contrast, partial and/or complete fluidization of at least a portion of the cuttings bed may decrease a resistance to motion of the drilling assembly and provide for motion of the drilling assembly through the cuttings bed without substantial relocation of the portion of the cuttings bed, thereby decreasing a potential for cuttings accumulation and/or packoff at an upstream location as the drilling assembly is removed from the wellbore.

Figure 5:
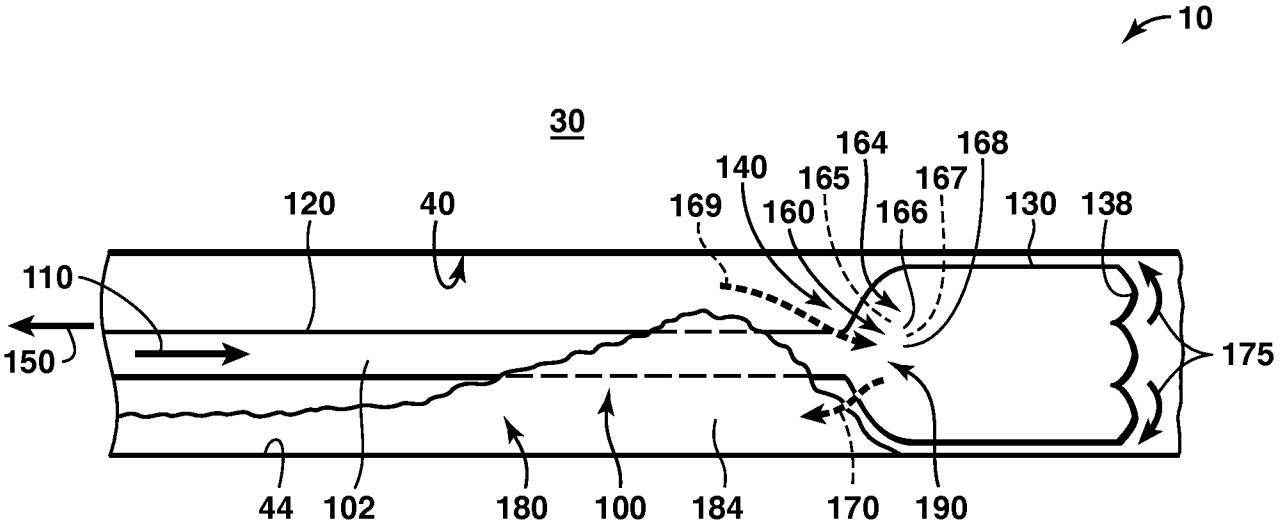
FIG. 5 is a schematic representation of an illustrative, non-exclusive example of a drilling assembly that includes a fluidizing assembly according to the present disclosure.

In order to decrease a potential for packoff within wellbore 40, drilling assembly 100 may include a fluidizing assembly 160 that is configured to fluidize, or at least partially fluidize, at least a portion of cuttings bed 180 and/or cuttings dune 184 that is proximal to transition region 140. An illustrative, non-exclusive example of such a drilling assembly 100 with fluidizing assembly 160 is shown in FIG. 5. In FIG. 5, fluidizing assembly 160 may inject a fluidizing stream 170 into wellbore 40. The fluidizing stream may be injected proximal to transition region 140 and into cuttings bed 180 or a portion thereof, such as into cuttings dune 184.

Injection of fluidizing stream 170 into a portion of cuttings bed 180 may, as discussed in more detail herein, increase the fluid pressure within the portion of the cuttings bed, decrease solid-solid stress within the portion of the cuttings bed, and/or at least partially fluidize the portion of the cuttings bed, thereby decreasing the shear strength of the cuttings bed. This may decrease a resistance to motion of the drilling assembly through the cuttings bed and/or provide for motion of the drilling assembly through the cuttings bed without substantial displacement of the cuttings bed along a length of wellbore 40.

It is within the scope of the present disclosure that the portion of the cuttings bed that is, or is at least partially, fluidized by the fluidizing stream may include any suitable portion, fraction, and/or region of the cuttings bed. As illustrative, non-exclusive examples, the portion of the cuttings bed may include a portion of the cuttings bed that is within 4 meters of the transition region at a given point in time, such as portions of the cuttings bed that are within 3.5 meters, 3 meters, 2.5 meters, 2 meters, 1.5 meters, 1 meter, 0.75 meters, 0.5 meters, 0.25 meters, 0.2 meters, 0.15 meters, 0.1 meters, or within 0.05 meters of the transition region.

Fluidizing stream 170 may include any suitable fluid stream that is configured to increase the pressure within the portion of cuttings bed 180. As an illustrative, non-exclusive example, fluidizing stream 170 may include a portion of drilling fluid stream 110, which also may be referred to herein as a diverted portion of the drilling fluid stream and/or a bypassed portion of the drilling fluid stream.

As shown in FIG. 5, drilling assembly 100 may be configured to divide, apportion, divert, or otherwise separate drilling fluid stream 110 into fluidizing stream 170 and undiverted portion 175, which may be provided to terminal end 138 of drilling assembly 100. This separation may be accomplished using any suitable structure, an illustrative, non-exclusive example of which includes a flow control assembly 190, and may include any suitable portion of the drilling fluid stream. As illustrative, non-exclusive examples, fluidizing stream 170 may include 1-70% of the drilling fluid stream, by volume, including 1-60%, 10-50%, 1-40%, 5-50%, 5-60%, 10-40%, 10-50%, 15-60%, 15-50%, 15-40%, or 20-50% of the drilling fluid stream, by volume. It is within the scope of the present disclosure that fluidizing stream 170 may form portions (or vol %) of the drilling fluid stream that are within, greater than, or less than these illustrative, non-exclusive ranges.

Additionally or alternatively, is within the scope of the present disclosure that fluidizing stream 170 may include a stream that originates from and/or within wellbore 40. As an illustrative, non-exclusive example, fluidizing assembly 160 may include and/or be in fluid communication with a fluid drive assembly 165 that is configured to receive a wellbore fluid stream 169 from within wellbore 40 and to produce fluidizing stream 170 therefrom. As a more specific illustrative, non-exclusive example, fluid drive assembly 165 may be present within and/or form a portion of drilling assembly 100 and may be in fluid communication with an inlet orifice 167 that is configured to provide the wellbore fluid stream from the wellbore to the fluid drive assembly. Although not required to all embodiments that include at least one inlet orifice 167 that is configured to receive wellbore fluid stream 169 from within the wellbore, the inlet orifice(s) 167 may be located on or proximate the bottom-hole assembly and/or within or proximate the transition region 140. Illustrative, non-exclusive examples of fluid drive assemblies 165 according to the present disclosure include any suitable structure that is configured to produce the fluidizing stream, an illustrative, non-exclusive example of which includes a pump.

It is further within the scope of the present disclosure that fluid drive assembly 165, when present, may utilize any suitable power source. As an illustrative, non-exclusive example, the fluid drive assembly may include an electrically powered fluid drive assembly and may receive electric current from any suitable AC and/or DC power source, illustrative, non-exclusive examples of which include an electric conduit, a cable, a wire, the drilling assembly, and/or a battery. As another illustrative, non-exclusive example, the fluid drive assembly may include a mechanically powered fluid drive assembly and may receive a mechanical power input from any suitable source, an illustrative, non-exclusive example of which includes the drilling assembly and/or a motion and/or rotation thereof Fluidizing assembly 160 may include any suitable structure that is configured to fluidize the portion of the cuttings bed, such as by injecting fluidizing stream 170 into the portion of the cuttings bed. It is within the scope of the present disclosure that the fluidizing assembly may be configured to selectively provide the fluidizing stream to a portion of the wellbore that includes the portion of the cuttings bed and/or to preferentially provide the fluidizing stream to the portion of the wellbore that includes the portion of the cuttings bed.

As an illustrative, non-exclusive example, the selectively providing may include providing the fluidizing stream when the fluidizing assembly is within and/or proximal to the portion of the wellbore and/or the portion of the cuttings bed, and it may further include ceasing the providing when the fluidizing assembly is not within and/or proximal to the portion of the wellbore and/or the portion of the cuttings bed. As another illustrative, non-exclusive example, the selectively providing may include selectively providing the fluidizing stream to a base of the cuttings bed, such as to a portion of the cuttings bed that is proximal to lower surface 44 of wellbore 40. The selectively providing additionally or alternatively may include ceasing the providing if the fluidizing stream would not be discharged into the cuttings bed and/or ceasing the providing if the fluidizing stream and/or a fluid orifice 166 from which the fluidizing stream may be discharged is greater than a threshold distance from the base of the cuttings bed. Illustrative, non-exclusive examples of threshold distances according to the present disclosure include threshold distances of (or optionally greater than) 0.01 meters, 0.02 meters, 0.03 meters, 0.04 meters, 0.05 meters, 0.1 meters, 0.2 meters, 0.25 meters, 0.3 meters, 0.4 meters, or 0.5 meters.

Fluid orifice 166 may include any suitable structure that is configured to provide at least a portion of the drilling fluid stream to the portion of the cuttings bed as the fluidizing stream. As an illustrative, non-exclusive example, fluid orifice 166 may include a diffuser 168. It is within the scope of the present disclosure that fluid orifice 166 may include a fixed orientation fluid orifice and/or a variable orientation fluid orifice and may be located at any suitable location around a circumference of and/or along a length of drilling assembly 100, first section 120, second section 130, transition region 140, and/or any suitable component thereof It is within the scope of the present disclosure that fluidizing assembly 160 may include any suitable number of fluid orifices, including 1, 2, 3, 4, 5, more than 5, more than 10, more than 15, or more than 20 fluid orifices and also may be referred to as including a plurality of fluid orifices. Each of the one or more fluid orifices that comprise the fluidizing assembly may include any suitable inner diameter, illustrative, non-exclusive examples of which include inner diameters of 0.25-5 cm, such as inner diameters of 0.5-4.5 cm, 0.75-4 cm, 1-3 cm, 1.5-2.5 cm, 2-3 cm, 0.25 cm, 0.5 cm, 0.75 cm, 1 cm, 1.5 cm, 2 cm, 2.5 cm, 2.54 cm, 3 cm, or 3.5 cm.

As discussed in more detail herein, fluidizing assembly 160 may be configured to increase the pressure within the selected portion of the cuttings bed. Thus, and in contrast to jets that may be configured to include a large pressure drop and thus a high fluid velocity at the outlet from the jet, fluidization assemblies according to the present disclosure may be configured for a relatively small pressure drop across the fluidizing assembly in order to transmit the higher pressure of the drilling fluid stream to the fluid present within the portion of the cuttings bed.

Illustrative, non-exclusive examples of pressure drops across fluidizing assembly 160, fluid orifice 166, and/or diffuser 168 according to the present disclosure include pressure drops that are less than 50% of a pressure of the drilling fluid stream within the transition region (i.e., prior to being discharged from fluid conduit 102) and/or a pressure differential between the pressure of the drilling fluid stream within the transition region and a nominal pressure within the wellbore outside both the drilling assembly and the selected portion of the cuttings bed. This may include pressure drops that are less than 40%, less than 30%, less than 25%, less than 20%, less than 15%, less than 10%, less than 5%, less than 3%, or less than 1% of the pressure of the drilling fluid stream within the transition region.

It is within the scope of the present disclosure that a velocity of the fluidizing stream within the fluid orifice may be less than a velocity of the undiverted portion of the drilling fluid stream that is injected into the wellbore from the terminal end of the drilling assembly. Additionally or alternatively, the velocity of the fluidizing stream within the fluid orifice may differ from a velocity of the drilling fluid stream within the transition region by less than 95%, less than 90%, less than 80%, less than 75%, less than 70%, less than 60%, less than 50%, less than 40%, less than 30%, less than 25%, less than 20%, less than 15%, less than 10%, less than 5%, less than 3%, less than 1%, 1-95%, 5-50%, 10-40%, 25-50%, 50-75%, or 30-90%, although velocity differences that are within or outside of these illustrative, non-exclusive ranges are also within the scope of the present disclosure.

Drilling assembly 100 and/or fluidizing assembly 160 also may include and/or be in communication with an orientation control assembly 164 that is configured to control an orientation of at least a portion of the fluidizing assembly. As an illustrative, non-exclusive example, orientation control assembly 164 may be configured to selectively control the orientation of the portion of the fluidizing assembly to direct, or otherwise selectively provide, the fluidizing stream to the portion of the cuttings bed. This may include selectively controlling a direction of fluidizing stream 170, such as by controlling an orientation of fluid orifice 166 from which the fluidizing stream is discharged. The orientation of fluid orifice 166 may be controlled with respect to any suitable location and/or structure, illustrative, non-exclusive examples of which include the drilling assembly, the wellbore, and/or the cuttings bed. Additionally or alternatively, the orientation of fluid orifice 166 may be controlled to direct the fluidizing stream that is discharged by the fluid orifice toward the cuttings bed.

As another illustrative, non-exclusive example, orientation control assembly 164 may include and/or be in communication with a rotary steerable system that is nominally configured to control an orientation of wellbore 40 within subsurface region 30. The rotary steerable system may be configured to control the orientation of fluidizing assembly 160, such as orientation control assembly 164.

Flow control system or assembly 190 may include any suitable structure that is configured to control, apportion, divide, divert, transfer, transduce, or otherwise separate drilling fluid stream 110, including at least a portion of the pressure and/or flow energy contained therein, into fluidizing stream 170, which may be supplied to fluidizing assembly 160, and undiverted portion 175. As illustrative, non-exclusive examples, flow control assembly 190 may include, for example, a valve, diverter, flapper, choke, burst or rupture system, shear assembly, power system, damper and/or other means to actuate the fluidizing tool assembly or components thereof, and/or regulate or control flow to or within the fluidizing assembly. As discussed in more detail herein, the flow control assembly may be configured to selectively vary, regulate, and/or actuate a portion of the drilling fluid stream that comprises the fluidizing stream and/or a ratio of a flow rate of the drilling fluid stream to a flow rate of the fluidizing stream. Control and/or operation of the flow control assembly may occur passively or actively, such as in response to a signal, a selected action, or as part of an autonomous or non-autonomous flow control assembly or system. The flow control assembly may respond to stimuli, such as mechanical, physical, electrical, optic, and/or other controlling operation. The flow control assembly may be positioned proximate or remote to the fluidizing assembly and in many embodiments, the flow control assembly and fluidizing assembly may be integrated into a substantially common system, while in other embodiments the flow control assembly may comprise a system that is distinct from but in operational engagement with the fluidizing assembly.

As discussed in more detail herein, drill rig 10 and/or drilling assembly 100 also may include and/or be in communication with a controller that is configured to regulate or otherwise control the operation of the drill rig and/or the drilling assembly. The controller may be configured to calculate a variable associated with the initiation of a packoff event as the drilling assembly is being removed from the wellbore. Illustrative, non-exclusive examples of variables associated with the initiation of a packoff event according to the present disclosure include a hook load, a down-hole or surface pressure, down-hole or surface torque, a fraction of the drilling fluid stream that comprises the fluidizing stream, an average diameter of the wellbore, a diameter of a portion of the wellbore, a diameter of a portion of the wellbore that is proximal to the transition region, a diameter of the first section, a diameter of the second section, an orientation of the wellbore, and/or an orientation of a portion of the wellbore that is proximal to the transition region.

The controller optionally may be configured to model and/or utilize a model of the drilling assembly as it is removed from the wellbore and/or to calculate a target portion of the drilling fluid stream that is supplied to the fluidizing assembly based at least in part on the model. Although not required to all embodiments, the model may be and/or include a hydraulics model. When utilized, the model may be based at least in part on a variable associated with the wellbore, a length of the wellbore, a diameter of the wellbore, a composition of a geological formation that contains the wellbore, a composition of the cuttings bed, a variable associated with the drilling assembly, a diameter of the drilling assembly, a diameter of the first section, a diameter of the second section, a diameter of a bottom-hole assembly associated with the drilling assembly, a cuttings bed height, a variable associated with the drilling fluid stream, a viscosity of the drilling fluid, and/or a variable associated with the drill rig.

The controller additionally or alternatively may be configured to maintain desired, or (pre)selected, operating conditions within the wellbore. As an illustrative, non-exclusive example, the controller may be configured to maintain a flow rate of the undiverted portion of the drilling fluid stream sufficient to provide for removal of cuttings from an annular region present between the wellbore and the second section.

As another illustrative, non-exclusive example, the controller may be configured to increase the portion of the drilling fluid stream that is supplied to the fluidizing assembly responsive to detecting that the hook load is greater than a maximum hook load threshold, a wellbore pressure is greater than a maximum wellbore pressure threshold, wellbore torque is greater than the maximum wellbore torque and/or that a wellbore diameter proximal to the fluidizing assembly is greater than a maximum threshold wellbore diameter. Conversely, the controller may be configured to decrease the portion of the drilling fluid stream that is supplied to the fluidizing assembly responsive to detecting that the hook load is less than a minimum hook load threshold, the wellbore pressure is less than a minimum wellbore pressure threshold, wellbore torque is less than the minimum wellbore torque and/or that the wellbore diameter proximal to the fluidizing assembly is less than a minimum threshold wellbore diameter.

Figure 6:
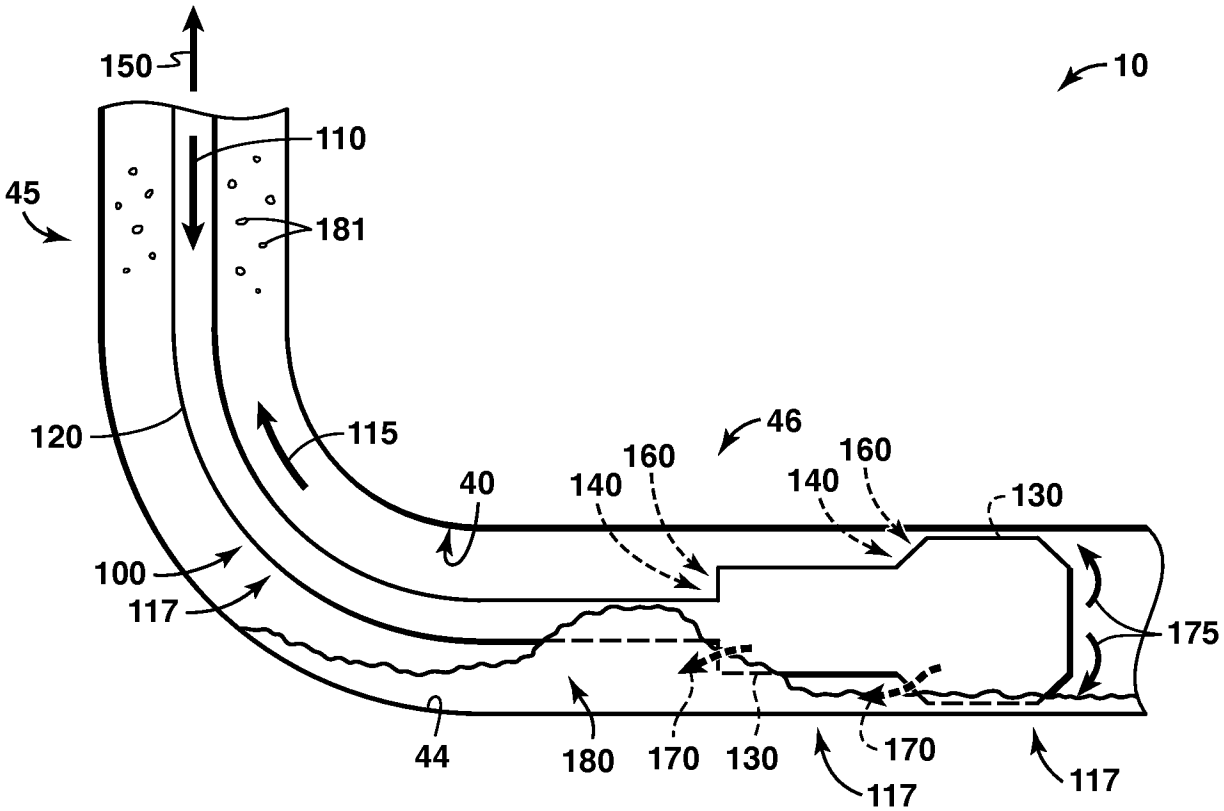
FIG. 6 is another schematic representation of illustrative, non-exclusive examples of a drilling assembly that includes a fluidizing assembly according to the present disclosure.

FIG. 6 provides another schematic representation of illustrative, non-exclusive examples of a drilling assembly 100 that includes a fluidizing assembly 160 according to the present disclosure. The drilling assembly of FIG. 6 is substantially similar to the drilling assembly of FIG. 5. Like components are numbered similarly and will not be discussed in more detail herein.

In FIG. 6, wellbore 40 includes a substantially vertical portion 45 and a substantially horizontal portion 46. Flow of return stream 115 within wellbore 40 may produce suspended cuttings 181 within the wellbore, which may be removed from the wellbore with the return stream. However, and as discussed in more detail herein, at least a portion of the cuttings present within the wellbore may settle under the influence of gravity to a lower surface 44 of the wellbore, producing cuttings bed 180.

FIG. 6 illustrates that drilling assembly 100 may include a plurality of sections 117, such as first section 120 and/or second section 130, that may be separated by a plurality of transition regions 140. At least a portion, and optionally all, of the transition regions associated with drilling assembly 100 may include fluidizing assembly 160. In addition, FIG. 6 also schematically illustrates that, as discussed in more detail herein, the use of fluidizing assembly 160 may provide for the removal of drilling assembly 100 from wellbore 40 in withdrawal direction 150 without substantial displacement of the cuttings bed from and/or within the wellbore and/or formation of a cuttings dune within the wellbore and/or the occurrence of packoff.

Figure 7:
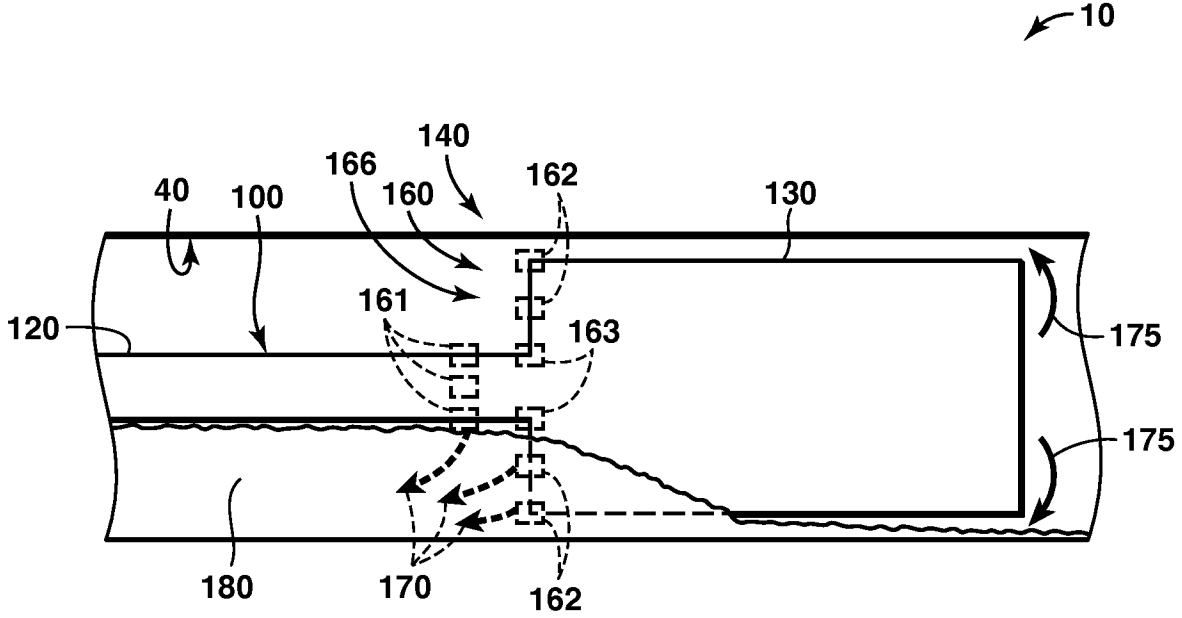
FIG. 7 is another schematic representation of illustrative, non-exclusive examples of a drilling assembly that includes a fluidizing assembly according to the present disclosure.

FIG. 7 provides another schematic representation of illustrative, non-exclusive examples of a drilling assembly 100 that includes a fluidizing assembly 160 according to the present disclosure. The drilling assembly of FIG. 7 is substantially similar to the drilling assembly of FIGS. 5-6. Like components are numbered similarly and will not be discussed in more detail herein.

FIG. 7 schematically illustrates that, as discussed in more detail herein, fluidizing assembly 160 may include one or more fluid orifices 166 that may be present at any suitable location along a length of and/or around an outer perimeter of drilling assembly 100. This may include fluid orifices that are operatively attached to, form a portion of, and/or are associated with first section 120 (as shown schematically at 161), fluid orifices that are operatively attached to, form a portion of, and/or are associated with second section 130 (as shown schematically at 162), and/or fluid orifices that are operatively attached to, form a portion of, and/or are associated with transition region 140 (as shown schematically at 163).

In addition, FIG. 7 also illustrates that, as discussed in more detail herein, drilling assembly 100 and/or a corresponding controller associated therewith may and/or may be configured to control the operation of the one or more fluid orifices that are associated with the fluidization assembly. Thus, and as shown in FIG. 7, one or more fluid orifices that are proximal to, within a threshold distance of, and/or within cuttings bed 180 may provide fluidizing stream 170 to the cuttings bed, while one or more fluid orifices that are not proximal to, within a threshold distance of, and/or within cuttings bed 180 may not provide a fluidizing stream.

Figure 8:
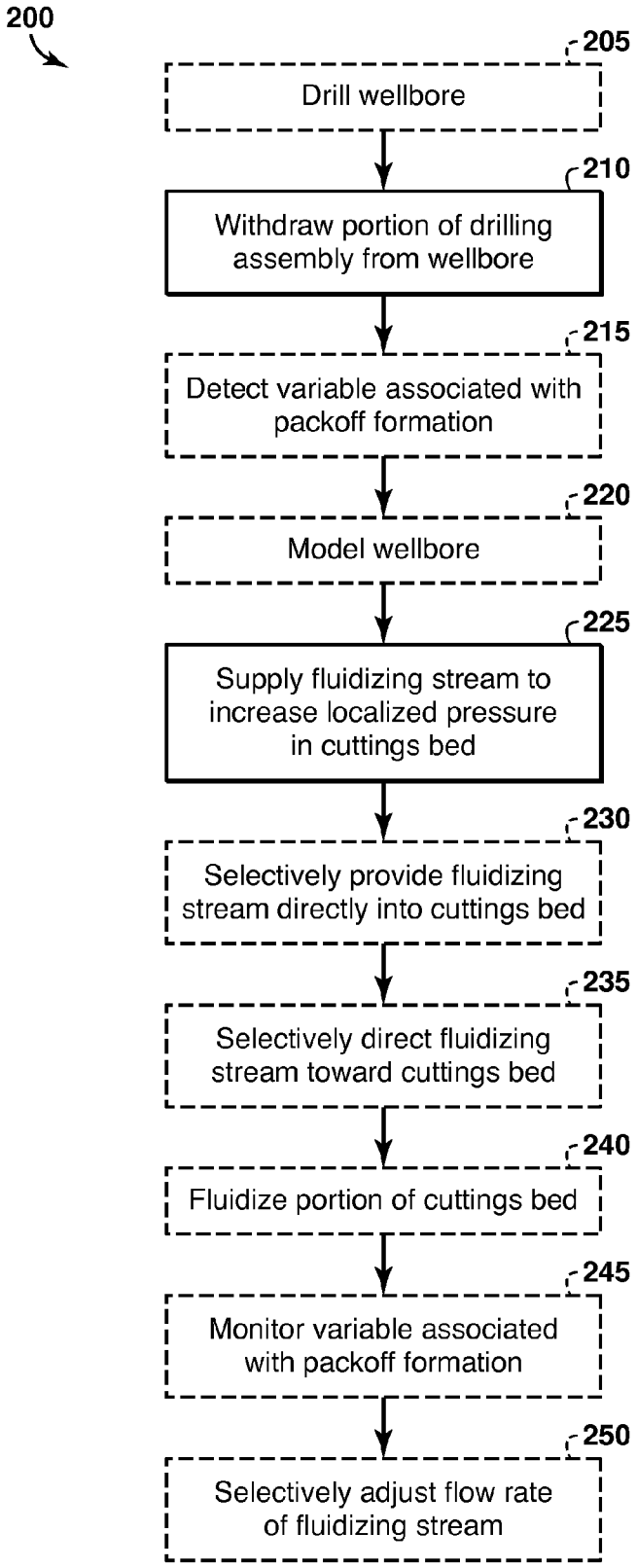
FIG. 8 is a flowchart depicting methods according to the present disclosure of removing a drilling assembly from a wellbore by at least partially fluidizing a portion of a cuttings bed.

FIG. 8 is a flowchart depicting illustrative, non-exclusive examples of methods according to the present disclosure of removing a drilling assembly from a wellbore. The methods optionally may include drilling the wellbore at 205 and include withdrawing at least a portion of the drilling assembly from the wellbore at 210. The methods further optionally may include detecting a variable associated with the initiation of a packoff event at 215 and modeling the wellbore at 220. The methods also include supplying a fluidizing stream to increase localized pressure in a portion of the cuttings bed at 225 and optionally may include selectively providing the fluidizing stream directly into the portion of the cuttings bed at 230, selectively directing the fluidizing stream toward the cuttings bed at 235, at least partially fluidizing the portion of the cuttings bed at 240, monitoring a variable associated with the initiation of a packoff event at 245, and/or selectively adjusting a flow rate of the fluidizing stream at 250.

Drilling the wellbore at 205 may include the use of a drill rig, drilling assembly, and/or drill bit to increase a length of the wellbore. This may include producing cuttings, which may be generated from a portion of the subsurface region that is removed by the drill bit. A portion of the cuttings may be removed from the wellbore in a return stream of drilling fluid and a portion of the cuttings may remain within the wellbore and may create and/or contribute to a cuttings bed. Drilling the wellbore may include drilling the wellbore at any suitable orientation and/or combination of orientations, illustrative, non-exclusive examples of which include wellbores that include a vertical portion, wellbores that include a horizontal portion, wellbores that include an angled portion, and/or wellbores that include a combination and/or plurality of vertical, horizontal, and/or angled portions.

Withdrawing at least a portion of the drilling assembly from the wellbore at 210 may include the use of any suitable structure to draw, pull, and/or remove the portion of the drilling assembly from the wellbore. The withdrawing may be performed in a continuous, or at least substantially continuous, manner in which a portion of the drilling assembly that remains within the wellbore is in constant, or at least substantially constant, motion in a withdrawal direction during the withdrawing. However, the withdrawing also may be discontinuous, such as when the withdrawing stops (or ceases), at least momentarily, during the withdrawing process.

As an illustrative, non-exclusive example, the withdrawing may stop to provide for removal of a portion of the drilling assembly, such as a piece of drill pipe and/or a portion of the bottom-hole assembly, from the drilling assembly. In general, the method may be performed while the (continuous and/or discontinuous) withdrawing is taking place and a portion of the drilling assembly remains within the wellbore.

Detecting a variable associated with the initiation of a packoff event at 215 may include the use of any suitable detector, transducer, sensor, and/or controller to detect the variable associated with the initiation of a packoff event. Illustrative, non-exclusive examples of variables associated with the initiation of a packoff event are discussed in more detail herein.

Modeling the wellbore at 220 may include the use of any suitable mathematical model, algorithm, relationship, and/or correlation to model, predict, and/or otherwise describe the wellbore and/or the removal of the drilling assembly from the wellbore. The modeling may be based, at least in part, on any suitable variable, including those variables that are discussed in more detail herein and may include calculating a target portion of the drilling fluid stream that comprises the fluidizing stream.

Supplying the fluidizing stream to increase localized pressure in the portion of the cuttings bed at 225 may include the use of any suitable structure to provide the fluidizing stream to the portion of the cuttings bed. This may include providing the fluidizing stream to the portion of the cuttings bed that is proximal to a transition region between a first portion of the drilling assembly and a second portion of the drilling assembly.

The fluidizing stream may include any suitable components, including those components that are discussed in more detail herein. As an illustrative, non-exclusive example, the supplying also may include injecting a packoff-inhibiting additive into the drilling fluid stream. The packoff-inhibiting additive may be configured to decrease attractive force among the particles that comprise the cuttings bed, decrease friction among the particles that comprise the cuttings bed, and/or increase lubrication among the particles that comprise the cuttings bed. Supplying the fluidizing stream also may include and/or be referred to as reducing a shear strength of the cuttings bed and/or increasing a fluid pore pressure within the cuttings bed.

Supplying the fluidizing stream also may include selectively providing the fluidizing stream based, or responsive, at least in part, on the variable associated with the initiation and/or the occurrence of packoff and/or controlling a flow rate of the fluidizing stream to and/or through the fluidizing assembly. As an illustrative, non-exclusive example, and as discussed in more detail herein, the selectively providing may include providing the fluidizing stream and/or increasing the flow rate of the fluidizing stream responsive to the variable associated with the initiation of packoff events being greater than a threshold value. As another illustrative, non-exclusive example, and as also discussed in more detail herein, the selectively providing may include ceasing the providing and/or decreasing the flow rate of the fluidizing stream responsive to the variable associated with the initiation and/or occurrence of packoff events being less than a threshold value. As yet another illustrative, non-exclusive example, the selectively providing may include maintaining a sufficient flow rate of the undiverted portion of the drilling fluid stream to provide for removal of cuttings from an annular region formed between the wellbore and the second portion.

Selectively providing the fluidizing stream directly into the cuttings bed at 230 may include selectively providing the fluidizing stream to the portion of the cuttings bed and/or selectively providing the fluidizing stream when the fluidizing assembly is proximal to the portion of the cuttings bed. As an illustrative, non-exclusive example, the selectively providing may include selectively providing the fluidizing stream based at least in part on a variable associated with the drilling assembly. Illustrative, non-exclusive examples of variables associated with the drilling assembly are discussed in more detail herein and may include an orientation of the drilling assembly within the wellbore, an orientation of the fluidizing assembly within the wellbore, and/or a distance between the transition region and the portion of the cuttings bed.

When the fluidizing assembly includes a plurality of fluid orifices, the selectively providing may include selectively providing the fluidizing stream to the fluidizing assembly and/or to a selected one and/or a selected portion of the plurality of fluid orifices responsive to an orientation and/or a location of the fluidizing assembly and/or the selected one and/or the selected portion of the plurality of fluid orifices. As an illustrative, non-exclusive example, the selectively providing may include selectively providing responsive to the fluidizing assembly and/or the selected one and/or portion of the plurality of fluid orifices being in contact with the portion of the cuttings bed, within a threshold distance of the portion of the cuttings bed (including the threshold distances that are discussed in more detail herein), at the bottom of the wellbore, and/or within a threshold distance of the bottom of the wellbore.

Selectively directing the fluidizing stream toward the cuttings bed at 235 may include the use of an orientation control structure to change, modify, and/or otherwise control the orientation and/or direction of the fluidizing stream. As an illustrative, non-exclusive example, the selectively directing may include orienting a fluid orifice associated with the fluidizing assembly such that the fluidizing stream emitted therefrom is directed toward the portion of the cuttings bed even if the fluid orifice is not in contact with and/or within a threshold distance of the portion of the cuttings bed.

Fluidizing the portion of the cuttings bed at 240 may include partially and/or completely fluidizing the cuttings bed. As discussed in more detail herein, the fluidizing may include increasing the fluid pressure within the portion of the cuttings bed to decrease and/or at least substantially eliminate solid-solid stress within the portion of the cuttings bed, which may cause the portion of the cuttings bed to behave in a fluid, or fluid-like manner. When the portion of the cuttings bed is at least partially fluidized, the withdrawing at 210 may include drawing the drilling assembly thorough the at least partially fluidized portion of the cuttings bed and/or drawing the drilling assembly through the at least partially fluidized portion of the cuttings bed without substantial displacement of the cuttings that comprise the cuttings bed along a length of the wellbore.

Monitoring the variable associated with the initiation and/or the occurrence of packoff at 245 and selectively adjusting the flow rate of the fluidizing stream at 250 may include monitoring any suitable variable associated with the initiation and/or the occurrence of packoff, illustrative, non-exclusive examples of which are discussed in more detail herein, during the withdrawing and selectively increasing and/or decreasing the flow rate of the fluidizing stream based at least in part thereon. As an illustrative, non-exclusive example, the monitoring and selectively adjusting may include detecting that the variable associated with the initiation and/or the occurrence of packoff is greater than a threshold value and/or outside a desired range of values and increasing and/or initiating flow of the fluidizing stream based at least in part thereon. As another illustrative, non-exclusive example, the monitoring and selectively adjusting may include detecting that the variable associated with the initiation and/or the occurrence of packoff is less than a threshold value and/or outside a desired range of values and decreasing and/or ceasing flow of the fluidizing stream based at least in part thereon.

It is within the scope of the present disclosure that the withdrawing at 210 may include withdrawing the drilling assembly from the wellbore without rotating the drilling assembly within the wellbore. Conversely, the withdrawing at 210 also may include withdrawing the drilling assembly from the wellbore while rotating the drilling assembly within the wellbore. In addition, it is also within the scope of the present disclosure that the withdrawing at 210 may include withdrawing the drilling assembly from the wellbore without reinserting the drilling assembly into the wellbore or, alternatively, withdrawing at least a first portion of the drilling assembly from the wellbore and later reinserting at least a second portion of the drilling assembly into the wellbore.

It is also within the scope of the present disclosure that the supplying at 225 may include supplying the fluidizing stream at least partially concurrently with the withdrawing at 210. Additionally or alternatively, the withdrawing may include withdrawing prior to the providing and/or providing prior to the withdrawing.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, programmed, utilized, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A drilling assembly configured to drill a wellbore, the drilling assembly comprising:

a transition region between a first section of the drilling assembly and a second section of the drilling assembly; and means for fluidizing a portion of a cuttings bed proximal the transition region.

A2. The drilling assembly of paragraph A1, wherein the first section has a first cross-sectional area, wherein the second section has a second cross-sectional area, wherein the first cross-sectional area is less than the second cross-sectional area, and further wherein the first section is farther from a terminal end of the drilling assembly than the second section.

A3. The drilling assembly of any of paragraphs A1-A2, wherein the drilling assembly further includes a fluid conduit, wherein the first section and the second section define at least a portion of the fluid conduit, and further wherein the fluid conduit is configured to transmit a drilling fluid stream to the terminal end of the drilling assembly.

A4. The drilling assembly of any of paragraphs A1-A3, wherein the means for fluidizing includes a fluidizing assembly configured to fluidize the portion of the cuttings bed proximal the transition region.

A5. The drilling assembly of paragraph A4 when dependent from paragraph A3, wherein the drilling assembly further includes a means for diverting a portion of the drilling fluid stream to the fluidizing assembly.

A6. The drilling assembly of paragraph A5, wherein the means for diverting a portion of the drilling fluid stream includes a flow control assembly configured to selectively divert a portion of the drilling fluid stream to the fluidizing assembly.

B1. A drilling assembly configured to drill a wellbore, the drilling assembly comprising:

a first section having a first cross-sectional area;

a second section having a second cross-sectional area, wherein the first cross-sectional area is less than the second cross-sectional area, and further wherein the first section is farther from a terminal end of the drilling assembly than the second section;

a fluid conduit, wherein the first section and the second section define at least a portion of the fluid conduit, and further wherein the fluid conduit is configured to transmit a drilling fluid stream to the terminal end of the drilling assembly;

a transition region between the first section and the second section;

a fluidizing assembly configured to fluidize a portion of a cuttings bed proximal the transition region; and a flow control assembly configured to selectively divert a portion of the drilling fluid stream to the fluidizing assembly.

C1. The drilling assembly of any of paragraphs A1-B1, wherein the first section includes at least one of a drill string and a drill pipe.

C2. The drilling assembly of any of paragraphs A1-C1, wherein the first section is configured to provide fluid and mechanical communication between a surface region and the second section.

C3. The drilling assembly of any of paragraphs A1-C2, wherein the second section includes at least one of a bottom-hole assembly and a drill collar.

C4. The drilling assembly of any of paragraphs A1-C3, wherein the second section is configured to selectively contact a terminal end of the wellbore and produce cuttings to increase a length of the wellbore, with cuttings being produced as the length of the wellbore is increased.

C5. The drilling assembly of paragraph C4, wherein the second section is configured to provide the drilling fluid stream to the terminal end of the drilling assembly to at least one of provide a motive force for the cuttings production, lubricate the second section, and provide a motive force for removal of the cuttings from the terminal end of the wellbore.

C6. The drilling assembly of any of paragraphs A3-C5, wherein the fluid conduit includes at least one of a drill string, a drill pipe, a drill collar, and a bottom-hole assembly.

C7. The drilling assembly of any of paragraphs A3-C6, wherein the fluid conduit is configured to provide fluid communication between the terminal end of the drilling assembly and a/the surface region, optionally wherein the fluid conduit is configured to transmit the drilling fluid stream between the terminal end of the drilling assembly and the surface region, and further optionally wherein the fluid conduit is configured to transmit the drilling fluid stream from the surface region to the terminal end of the drilling assembly.

C8. The drilling assembly of any of paragraphs A1-C7, wherein the transition region operatively attaches the first section to the second section, and optionally wherein the transition region includes a coupling configured to operatively attach the first section to the second section, and further optionally wherein the coupling includes a threaded connection.

C9. The drilling assembly of any of paragraphs A2-C8, wherein the first cross-sectional area is measured transverse to a longitudinal axis of the first section, and optionally wherein the first cross-sectional area includes at least one of an outer diameter of the first section and an effective outer diameter of the first section.

C10. The drilling assembly of any of paragraphs A2-C9, wherein the second cross-sectional area is measured transverse to a longitudinal axis of the second section, and optionally wherein the second cross-sectional area includes at least one of an outer diameter of the second section and an effective outer diameter of the second section.

C11. The drilling assembly of any of paragraphs A2-C10, wherein a ratio of the second cross-sectional area to the first cross-sectional area is at least 1.1:1, optionally including ratios of at least 1.2:1, 1.3:1, 1.4:1, 1.5:1, 1.6:1, 1.7:1, 1.8:1, 1.9:1, 2:1, 2.25:1, 2.5:1, 3:1, 4:1, or at least 5:1, and further optionally including ratios of between 1.1:1 and 2:1, between 1.5:1 and 3:1, or between 1:5:1 and 5:1.

C12. The drilling assembly of any of paragraphs A5-C11, wherein the fluidizing assembly is configured to provide the portion of the drilling fluid stream to the portion of the cuttings bed as a fluidizing stream.

C13. The drilling assembly of paragraph C12, wherein the fluidizing stream is configured to increase a local pressure within the portion of the cuttings bed.

C14. The drilling assembly of any of paragraphs C12-C13, wherein the fluidizing stream is configured to decrease a solid-solid shear stress within the portion of the cuttings bed.

C15. The drilling assembly of any of paragraphs C12-C14, wherein the fluidizing stream is configured to at least partially fluidize the portion of the cuttings bed, and optionally wherein the fluidizing stream is configured to completely fluidize the portion of the cuttings bed.

C16. The drilling assembly of any of paragraphs C12-C15, wherein the fluidizing assembly is configured to selectively provide the fluidizing stream to a portion of the wellbore that includes the portion of the cuttings bed, optionally wherein the fluidizing assembly is configured to preferentially provide the fluidizing stream to the portion of the wellbore that includes the portion of the cuttings bed, and further optionally wherein the fluidizing assembly is configured to provide a substantial portion, a majority, substantially all, or all of the fluidizing stream to the portion of the wellbore that includes the portion of the cuttings bed.

C17. The drilling assembly of any of paragraphs C12-C16, wherein the fluidizing stream includes 1-70% of the drilling fluid stream, by volume, optionally including 1-60%, 1-50%, 1-40%, 5-50%, 5-60%, 10-40%, 10-50%, 15-60%, 15-50%, 15-40%, or 20-50% of the drilling fluid stream, by volume.

C18. The drilling assembly of any of paragraphs C12-C17, wherein the fluidizing assembly is configured to provide the fluidizing stream when the drilling assembly is being removed from the wellbore, and optionally wherein the fluidizing assembly is configured to not provide the fluidizing stream when the drilling assembly is being utilized to lengthen the wellbore.

C19. The drilling assembly of any of paragraphs C12-C18, wherein the drilling assembly is configured to selectively control an orientation of at least a portion of the fluidizing assembly to selectively provide the fluidizing stream to the portion of the cuttings bed.

C20. The drilling assembly of paragraph C19, wherein the drilling assembly includes a rotary steerable system, and further wherein the rotary steerable system is configured to control the orientation of the at least a portion of the fluidizing assembly, and optionally wherein the fluidizing assembly is coupled to the rotary steering system, and further optionally wherein the fluidizing assembly is configured to emit the fluidizing stream from the rotary steering system to fluidize the portion of the cuttings bed proximal to the transition region.

C21. The drilling assembly of any of paragraphs A1-C20, wherein the portion of the cuttings bed includes a portion of the cuttings bed that is within 4 meters of the transition region, optionally including a portion of the cuttings bed that is within 3.5 meters, within 3 meters, within 2.5 meters, within 2 meters, within 1.5 meters, within 1 meter, within 0.75 meters, within 0.5 meters, within 0.25 meters, within 0.2 meters, within 0.15 meters, within 0.1 meters, or within 0.05 meters of the transition region.

C22. The drilling assembly of any of paragraphs A5-C21, wherein the fluidizing assembly includes a fluid orifice configured to provide the portion of the drilling fluid stream to the portion of the cuttings bed as a/the fluidizing stream, and optionally wherein the fluidizing assembly includes a diffuser.

C23. The drilling assembly of paragraph C22, wherein the fluid orifice is located in at least one of on a drill pipe associated with the drilling assembly, on a bottom-hole assembly associated with the drilling assembly, on a coupling associated with the drilling assembly, in the transition region, proximal to the transition region, along a length of at least a portion of the drilling assembly, and around a circumference of at least a portion of the drilling assembly.

C24. The drilling assembly of any of paragraphs C22-C23, wherein the fluidizing assembly includes a plurality of fluid orifices, and optionally wherein the fluidizing assembly includes a plurality of diffusers.

C25. The drilling assembly of any of paragraphs C22-C24, wherein the fluid orifice includes at least one of a fixed orientation fluid orifice and a fluid orifice that is configured to have a selectively varied orientation.

C26. The drilling assembly of any of paragraphs C22-C25, wherein the fluid orifice includes an inner diameter of 0.25-5 cm, optionally including inner diameters of 0.5-4.5 cm, 0.75-4 cm, 1-3 cm, or 1.5-2.5 cm, and further optionally including inner diameters of 0.25 cm, 0.5 cm, 0.75 cm, 1 cm, 1.5 cm, 2 cm, 2.5 cm, 2.54 cm, 3 cm, or 3.5 cm.

C27. The drilling assembly of any of paragraphs C22-C26, wherein a pressure drop across the fluid orifice is less than 50% of a pressure of the drilling fluid stream within the transition region, optionally including pressure drops that are least less than 40%, less than 30%, less than 25%, less than 20%, less than 15%, less than 10%, less than 5%, less than 3%, or less than 1% of the pressure of the drilling fluid stream within the transition region.

C28. The drilling assembly of any of paragraphs C22-C27, wherein a velocity of the fluidizing stream within the fluid orifice is less than a velocity of an undiverted portion of the drilling fluid stream that is injected into the wellbore from a/the terminal end of the drilling assembly.

C29. The drilling assembly of any of paragraphs C22-C27, wherein a velocity of the fluidizing stream within the fluid orifice differs from a velocity of the drilling fluid stream within the transition region by less than 95%, and optionally wherein the velocity of the fluidizing stream within the fluid orifice differs from the velocity of the drilling fluid stream within the transition region by less than 90%, less than 80%, less than 75%, less than 70%, less than 60%, less than 50%, less than 40%, less than 30%, less than 35%, 20%, less than 15%, less than 10%, less than 5%, less than 3%, less than 1%, 1-95%, 5-50%, 10-40%, 25-50%, 50-75%, or 30-90%.

C30. The drilling assembly of any of paragraphs A6-C29, wherein the flow control assembly is configured to divert the portion of the drilling fluid stream to the fluidizing assembly as a/the fluidizing stream.

C31. The drilling assembly of paragraph C30, wherein the flow control assembly is configured to selectively vary the portion of the drilling fluid stream that comprises the fluidizing stream.

C32. The drilling assembly of paragraph C31, wherein the fluidizing stream includes 1-70% of the drilling fluid stream, by volume, optionally including 1-60%, 1-50%, 1-40%, 5-50%, 5-60%, 10-40%, 10-50%, 15-60%, 15-50%, 15-40%, or 20-50% of the drilling fluid stream, by volume.

C33. The drilling assembly of any of paragraphs A1-C32, wherein the transition region is at least 5 meters from a/the terminal end of the drilling assembly, and optionally wherein the transition region is at least 10 meters, at least 15 meters, at least 20 meters, at least 25 meters, at least 30 meters, at least 40 meters, or at least 50 meters from the terminal end of the drilling assembly.

C34. The drilling assembly of any of paragraphs A3-C33, wherein the drilling fluid stream includes at least one of drilling mud, water, water-based mud, oil-based mud, clay, a viscosity-control additive, a stability-enhancing additive, a coolant, a lubricant, and a packoff-inhibiting additive.

C35. The drilling assembly of any of paragraphs A1-C34, wherein the wellbore forms a portion of a hydrocarbon well.

C36. The drilling assembly of any of paragraphs B1-C35, wherein the drilling assembly optionally includes the fluid conduit, and further wherein the flow control assembly configured to selectively divert a portion of the drilling fluid stream to the fluidizing assembly is, additionally or alternatively, a fluid drive assembly configured to receive a wellbore fluid stream from within the wellbore and to provide the wellbore fluid stream to the fluidizing assembly, wherein the fluidizing assembly is configured to provide the wellbore fluid stream to the portion of the cuttings bed as a fluidizing stream.

D1. A drill rig, comprising:

the drilling assembly of any of paragraphs A1-C36;

a mechanical drive assembly in mechanical communication with the drilling assembly; and a fluid supply assembly in fluid communication with the drilling assembly and configured to supply a drilling fluid stream to the drilling assembly.

D2. The drill rig of paragraph D1, wherein the drill rig further includes a controller configured to control the operation of the drill rig, and optionally wherein the controller is configured to control the operation of the flow control assembly based, at least in part, on a hydraulics model of at least a portion of the wellbore.

D3. The drill rig of paragraph D2, wherein the controller is configured to detect a variable associated with the initiation and/or the occurrence of packoff events, and optionally wherein the variable associated with the initiation and/or the occurrence of packoff events includes at least one of a hook load, a down-hole pressure, a surface pressure, a down-hole torque, a surface torque, a fraction of the drilling fluid stream that comprises a fluidizing stream, an average diameter of the wellbore, a diameter of a portion of the wellbore, a diameter of a portion of the wellbore that is proximal to the transition region, a diameter of the first section, a diameter of the second section, an orientation of the wellbore, and an orientation of a portion of the wellbore that is proximal to the transition region.

D4. The drill rig of any of paragraphs D2-D3, wherein the controller is configured to model the drilling assembly as it is removed from the wellbore and calculate a target portion of the drilling fluid stream that is supplied to a/the fluidizing assembly to fluidize the portion of the cuttings bed.

D5. The drill rig of paragraph D4, wherein the model is based at least in part on at least one of a variable associated with the wellbore, an average diameter of the wellbore, a diameter of a portion of the wellbore, a length of the wellbore, a composition of a geological formation that contains the wellbore, a composition of the cuttings bed, a variable associated with the drilling assembly, a diameter of the drilling assembly, a diameter of the first section, a diameter of the second section, a diameter of a bottom-hole assembly associated with the drilling assembly, a cuttings bed height, a variable associated with the drilling fluid stream, a viscosity of the drilling fluid, and a variable associated with the drill rig.

D6. The drill rig of any of paragraphs D4-D5, wherein the drilling fluid stream includes an undiverted portion that is supplied to a/the terminal end of the drilling assembly, and further wherein the model is configured to maintain a flow rate of the undiverted portion sufficient to provide for removal of cuttings from an annular region formed by the wellbore and a bottom-hole assembly associated with the drilling assembly.

D7. The drill rig of any of paragraphs D2-D6, wherein the controller is configured to increase a portion of the drilling fluid stream that is supplied to a/the fluidizing assembly responsive to detecting at least one of a hook load that is greater than a maximum hook load threshold, a wellbore pressure that is greater than a maximum wellbore pressure threshold, and a wellbore diameter proximal to the fluidizing assembly that is greater than a maximum threshold wellbore diameter.

D8. The drill rig of any of paragraphs D2-D7, wherein the controller is configured to decrease a/the portion of the drilling fluid stream that is supplied to a/the fluidizing assembly responsive to detecting at least one of a hook load that is less than a minimum hook load threshold, a wellbore pressure that is less than a minimum wellbore pressure threshold, and a wellbore diameter proximal to the fluidizing assembly that is less than a minimum threshold wellbore diameter, and optionally wherein the controller is configured to cease a flow of the portion of the drilling fluid stream that is supplied to the fluidizing assembly responsive to detecting at least one of a hook load that is less than a minimum hook load threshold, a wellbore pressure that is less than a minimum wellbore pressure threshold, and a wellbore diameter proximal to the fluidizing assembly that is less than a minimum threshold wellbore diameter.

E1. A method of removing a drilling assembly from a wellbore, wherein the drilling assembly includes a transition region between a first section including a first cross-sectional area and a second section including a second cross-sectional area, wherein the first cross-sectional area is less than the second cross-sectional area, wherein the first section is farther from a terminal end of the drilling assembly than the second section, and further wherein the drilling assembly includes a fluid conduit configured to transmit a drilling fluid stream, the method comprising:

withdrawing at least a portion of the drilling assembly from the wellbore; and providing a fluidizing stream to a portion of a cuttings bed proximal the transition region, wherein the fluidizing stream includes a portion of the drilling fluid stream.

E2. The method of paragraph E1, wherein the method further includes detecting a variable associated with the initiation and/or the occurrence of packoff within the wellbore.

E3. The method of paragraph E2, wherein the variable associated with the initiation and/or the occurrence of packoff includes at least one of a hook load, a down-hole pressure, a surface pressure, a down-hole torque, a surface torque, a fraction of the drilling fluid stream that comprises the fluidizing stream, an average diameter of the wellbore, a diameter of a portion of the wellbore, a diameter of a portion of the wellbore that is proximal to the transition region, the first cross-sectional area, the second cross-sectional area, an orientation of the wellbore, and an orientation of a portion of the wellbore that is proximal to the transition region.

E4. The method of any of paragraphs E2-E3, wherein the providing includes selectively providing the fluidizing stream based at least in part on the variable associated with the initiation and/or the occurrence of packoff.

E5. The method of paragraph E4, wherein the selectively providing includes controlling a flow rate of the fluidizing stream.

E6. The method of any of paragraphs E4-E5, wherein the fluidizing stream comprises a diverted portion of the drilling fluid stream, and further wherein the drilling fluid stream further includes an undiverted portion of the drilling fluid stream.

E7. The method of paragraph E6, wherein the selectively providing includes maintaining a sufficient flow rate of the undiverted portion of the drilling fluid stream to provide for removal of cuttings from an annular region formed by the wellbore and a bottom-hole assembly associated with the drilling assembly.

E8. The method of any of paragraphs E6-E7, wherein the selectively providing includes selectively providing 1 to 70% of the drilling fluid stream as the fluidizing stream, optionally including 1-60%, 1-50%, 1-40%, 5-50%, 5-60%, 10-40%, 10-50%, 15-60%, 15-50%, 15-40%, or 20-50% of the drilling fluid stream.

E9. The method of any of paragraphs E5-E8, wherein the selectively providing includes increasing the flow rate of the fluidizing stream responsive to detecting at least one of a hook load that is greater than a maximum hook load threshold, a wellbore pressure that is greater than a maximum wellbore pressure, a torque that is greater than a maximum torque, and a wellbore diameter proximal to the transition region that is greater than a maximum threshold wellbore diameter.

E10. The method of any of paragraphs E5-E9, wherein the selectively providing includes decreasing the flow rate of the fluidizing stream responsive to detecting at least one of a hook load that is less than a minimum hook load threshold, a wellbore pressure that is less than a minimum wellbore pressure, a torque that is less than a minimum torque, and a wellbore diameter proximal to the transition region that is less than a minimum threshold wellbore diameter, and optionally wherein the decreasing includes ceasing the flow rate of the fluidizing stream.

E11. The method of any of paragraphs E1-E10, wherein the providing includes selectively providing the fluidizing stream based at least in part on a variable associated with the drilling assembly, and optionally wherein the variable associated with the drilling assembly includes at least one of an orientation of the drilling assembly within the wellbore, an orientation of a fluidizing assembly within the wellbore, and a distance between the transition region and the portion of the cuttings bed.

E12. The method of paragraph E11, wherein the drilling assembly includes a fluidizing assembly that includes a plurality of fluid orifices, and further wherein the selectively providing includes selectively providing the fluidizing stream to a selected one of the plurality of fluid orifices responsive at least in part to at least one of an orientation of the selected one of the plurality of fluid orifices and a location of the selected one of the plurality of fluid orifices with respect to a location of the portion of the cuttings bed.

E13. The method of paragraph E12, wherein the method includes providing the fluidizing stream to the selected one of the plurality of fluid orifices responsive to the selected one of the plurality of fluid orifices being within a threshold distance of the portion of the cuttings bed, and optionally wherein the threshold distance includes a distance of less than 0.5 meters, further optionally including threshold distances of less than 0.4, less than 0.3, less than 0.25, less than 0.2, less than 0.1, less than 0.05 meters, less than 0.04 meters, less than 0.03 meters, less than 0.02 meters, or less than 0.01 meters.

E14. The method of any of paragraphs E12 -E13, wherein the drilling assembly includes an orientation detection device configured to detect an orientation of each of the plurality of fluid orifices, wherein the method further includes detecting the orientation of each of the plurality of fluid orifices, and further wherein the method includes providing the fluidizing stream to the selected one of the plurality of fluid orifices responsive to detecting that the selected one of the plurality of fluid orifices is within a threshold distance of a bottom surface of the wellbore, and optionally wherein the threshold distance includes a distance of less than 0.5 meters, further optionally including threshold distances of less than 0.4, less than 0.3, less than 0.25, less than 0.2, less than 0.1, less than 0.05 meters, less than 0.04 meters, less than 0.03 meters, less than 0.02 meters, or less than 0.01 meters.

E15. The method of any of paragraphs E12 -E14, wherein the selected one of the plurality of fluid orifices includes an orientation control assembly configured to control the orientation of the selected one of the plurality of orifices with respect to at least one of the drilling assembly, the wellbore, and the cuttings bed, and further wherein the method includes controlling the orientation of the selected one of the plurality of fluid orifices, optionally wherein the controlling includes directing a portion of the fluidizing stream that flows through the selected one of the plurality of fluid orifices toward the cuttings bed.

E16. The method of any of paragraphs E12-E15, wherein the selectively providing includes selectively providing the fluidizing stream to a base of the cuttings bed, and optionally wherein the selectively providing includes ceasing providing the fluidizing stream to the selected one of the plurality of fluid orifices responsive to the selected one of the plurality of fluid orifices being greater than a threshold distance from the base of the cuttings bed, and further optionally wherein the threshold distance includes a threshold distance of greater than 0.01 meters, optionally including threshold distances of greater than 0.02 meters, greater than 0.03 meters, greater than 0.04 meters, greater than 0.05 meters, greater than 0.1 meters, greater than 0.2 meters, greater than 0.25 meters, greater than 0.3 meters, greater than 0.4 meters, or greater than 0.5 meters.

E17. The method of any of paragraphs E12-E16, wherein at least a portion of the plurality of fluid orifices includes a diffuser.

E18. The method of any of paragraphs E1-E17, wherein the method further includes modeling the drilling assembly as it is withdrawn from the wellbore.

E19. The method of paragraph E18, wherein the modeling includes calculating a target portion of the drilling fluid stream that comprises the fluidizing stream.

E20. The method of any of paragraphs E18-E19, wherein the providing includes selectively providing the fluidizing stream responsive at least in part on at least one of the modeling and the calculating.

E21. The method of any of paragraphs E18-E20, wherein the modeling is based at least in part on at least one of a variable associated with the wellbore, an average diameter of the wellbore, a diameter of a portion of the wellbore, a length of the wellbore, an orientation of the wellbore, a composition of a geological formation that contains the wellbore, a composition of the cuttings bed, a variable associated with the drilling assembly, a diameter of the drilling assembly, the first cross-sectional area, the second cross-sectional area, a diameter of a bottom-hole assembly associated with the drilling assembly, a cuttings bed height, a variable associated with the drilling fluid stream, a viscosity of the drilling fluid, and a variable associated with a drill rig.

E22. The method of any of paragraphs E1-E21, wherein the method further includes injecting a packoff-inhibiting additive into the drilling fluid stream.

E23. The method of any of paragraphs E1-E22, wherein the drilling fluid stream includes at least one of drilling mud, water, water-based mud, oil-based mud, clay, a viscosity-control additive, a stability-enhancing additive, a coolant, a lubricant, and a packoff-inhibiting additive.

E24. The method of any of paragraphs E1-E23 wherein, prior to the withdrawing, the method further includes drilling at least a/the portion of the wellbore, and optionally wherein the portion of the wellbore includes at least one of a vertical portion, a horizontal portion, and an angled portion.

E25. The method of any of paragraphs E1-E24, wherein the method further includes reducing a shear strength of the cuttings bed.

E26. The method of any of paragraphs E1-E25, wherein the method further includes increasing a fluid pore pressure within the cuttings bed.

E27. The method of any of paragraphs E1-E26, wherein the method further includes at least partially fluidizing the portion of the cuttings bed, and optionally wherein the method includes fluidizing the portion of the cuttings bed.

E28. The method of paragraph E27, wherein the withdrawing includes drawing the drilling assembly through the fluidized portion of the cuttings bed, and optionally wherein the withdrawing includes drawing the drilling assembly through the fluidized portion of the cuttings bed without substantial displacement of cuttings that comprise the cuttings bed.

E29. The method of any of paragraphs E1-E28, wherein the portion of the drilling fluid stream that comprises the fluidizing stream includes 1-70% of the drilling fluid stream, optionally including 1-60%, 1-50%, 1-40%, 5-50%, 5-60%, 10-40%, 10-50%, 15-60%, 15-50%, 15-40%, or 20-50% of the drilling fluid stream.

E30. The method of any of paragraphs E1-E29, wherein the first section includes at least one of a drill string and a drill pipe.

E31. The method of any of paragraphs E1-E30, wherein the second section includes at least one of a bottom-hole assembly and a drill collar.

E32. The method of any of paragraphs E1-E31, wherein the wellbore forms a portion of a hydrocarbon well.

E33. The method of any of paragraphs E1-E32, wherein the withdrawing includes withdrawing the drilling assembly from the wellbore without rotating the drilling assembly within the wellbore.

E34. The method of any of paragraphs E1-E33, wherein the withdrawing includes withdrawing the drilling assembly from the wellbore without reinserting the drilling assembly into the wellbore.

E35. The method of any of paragraphs E1-E34, wherein the providing includes providing at least partially concurrently with the withdrawing, and optionally wherein the providing included providing concurrently with the withdrawing.

E36. The method of any of paragraphs E1-E35, wherein the method includes withdrawing prior to providing.

E37. The method of any of paragraphs E1-E36, wherein the method includes providing prior to withdrawing.

E38. The method of any of paragraphs E1-E37, wherein the providing includes providing the fluidizing stream through at least one of a fluid orifice and a diffuser, and optionally wherein the providing includes providing the fluidizing stream through at least one of a plurality of fluid orifices and a plurality of diffusers.

E39. The method of any of paragraphs E1-E38, wherein the providing includes providing the fluidizing stream at a fluidizing stream pressure that is within 50% of a pressure of the drilling fluid stream within the transition region, and optionally wherein the pressure of the fluidizing stream is within 40%, within 30%, within 25%, within 20%, within 15%, within 10%, within 5%, within 3%, or within 1% of the pressure of the drilling fluid stream within the transition region.

E40. The method of any of paragraphs E1-E39, wherein the providing includes providing the fluidizing stream at a velocity that is less than a velocity of an/the undiverted portion of the drilling fluid stream that is injected into the wellbore from a/the terminal end of the drilling assembly.

E41. The method of any of paragraphs E1-E40, wherein the providing includes providing the fluidizing stream at a velocity that is within 95% of a velocity of the drilling fluid stream within the transition region, and optionally wherein the velocity of the fluidizing stream is within 90%, within 80%, within 75%, within 70%, within 60%, within 50%, 40%, within 30%, within 25%, within 20%, within 15%, within 10%, within 5%, within 3%, within 1%, within 1-95%, within 5-50%, within 10-40%, within 25-50%, within 50-75%, or within 30-90% of the velocity of the drilling fluid stream within the transition region.

E42. The method of any of paragraphs E1-E41, wherein the fluidizing stream, additionally or alternatively, includes a wellbore fluid stream that is received into the drilling assembly from within the wellbore.

F1. The method of any of paragraphs E1-E42 performed using the drilling assembly of any of paragraphs A1-C36 or the drill rig of any of paragraphs D1-D8.

F2. A drill rig, comprising:

the drilling assembly of any of paragraphs A1-C36; and a controller configured to perform the method of any of paragraphs E1-E42.

G1. The use of the methods of any of paragraphs E1-E42 with any of the drilling assemblies of any of paragraphs A1-C36 or any of the drill rigs of any of paragraphs D1-D8.

G2. The use of the drilling assemblies of any of paragraphs A1-C36 or any of the drill rigs of any of paragraphs D1-D8 with any of the methods of any of paragraphs E1-E42.

G3. The use of any of the drilling assemblies of any of paragraphs A1-C36, any of the drill rigs of any of paragraphs D1-D8, or any of the methods of any of paragraphs E1-E42 to drill a/the wellbore.

G4. The use of any of the drilling assemblies of any of paragraphs A1-C36, any of the drill rigs of any of paragraphs D1-D8, or any of the methods of any of paragraphs E1-E42 to remove the drilling assembly from the wellbore.

G5. The use of a fluidizing assembly to fluidize a cuttings bed proximal a transition region of a drilling assembly to inhibit packoff during removal of the drilling assembly from a wellbore.

PCT1. A drilling assembly configured to drill a wellbore, the drilling assembly comprising:

a first section having a first cross-sectional area;

a second section having a second cross-sectional area, wherein the first cross-sectional area is less than the second cross-sectional area, and further wherein the first section is farther from a terminal end of the drilling assembly than the second section;

a fluid conduit, wherein the first section and the second section define at least a portion of the fluid conduit, and further wherein the fluid conduit is configured to transmit a drilling fluid stream to the terminal end of the drilling assembly;

a transition region between the first section and the second section;

a fluidizing assembly configured to fluidize a portion of a cuttings bed proximal the transition region; and a flow control assembly configured to selectively divert a portion of the drilling fluid stream to the fluidizing assembly, wherein the fluidizing assembly is configured to provide the portion of the drilling fluid stream to the portion of the cuttings bed as a fluidizing stream.

PCT2. The drilling assembly of paragraph PCT 1, wherein the fluidizing assembly is configured to provide the fluidizing stream when the drilling assembly is being removed from the wellbore.

PCT3. The drilling assembly of any of paragraphs PCT1-PCT2, wherein the drilling assembly is configured to selectively control an orientation of at least a portion of the fluidizing assembly to selectively provide the fluidizing stream to the portion of the cuttings bed.

PCT4. The drilling assembly of any of paragraphs PCT1-PCT3, wherein the fluidizing assembly includes at least one of a plurality of fluid orifices and a plurality of diffusers configured to provide the fluidizing stream.

PCT5. The drilling assembly of paragraph PCT4, wherein the plurality of fluid orifices include an inner diameter of 1-3 cm, and further wherein a pressure drop across the plurality of fluid orifices is less than 25% of a pressure of the drilling fluid stream within the transition region.

PCT6. A drill rig, comprising:

the drilling assembly of paragraph PCT1;

a mechanical drive assembly in mechanical communication with the drilling assembly;

a fluid supply assembly in fluid communication with the drilling assembly and configured to supply the drilling fluid stream to the drilling assembly; and a controller configured to control the operation of the drill rig.

PCT7. The drill rig of paragraph PCT6, wherein the controller is configured to increase the portion of the drilling fluid stream that is supplied to the fluidizing assembly responsive to detecting at least one of a hook load that is greater than a maximum hook load threshold, a wellbore pressure that is greater than a maximum wellbore pressure threshold, and a wellbore diameter proximal to the fluidizing assembly that is greater than a maximum threshold wellbore diameter, and further wherein the controller is configured to decrease the portion of the drilling fluid stream that is supplied to the fluidizing assembly responsive to detecting at least one of a hook load that is less than a minimum hook load threshold, a wellbore pressure that is less than a minimum wellbore pressure threshold, and a wellbore diameter proximal to the fluidizing assembly that is less than a minimum threshold wellbore diameter.

PCT8. A method of removing a drilling assembly from a wellbore, wherein the drilling assembly includes a transition region between a first section including a first cross-sectional area and a second section including a second cross-sectional area, wherein the first cross-sectional area is less than the second cross-sectional area, wherein the first section is farther from a terminal end of the drilling assembly than the second section, and further wherein the drilling assembly includes a fluid conduit configured to transmit a drilling fluid stream, the method comprising:

withdrawing at least a portion of the drilling assembly from the wellbore;

detecting a variable associated with the initiation and/or the occurrence of packoff within the wellbore; and providing a fluidizing stream to a portion of a cuttings bed proximal the transition region, wherein the fluidizing stream includes a portion of the drilling fluid stream, and further wherein the providing includes selectively providing the fluidizing stream based at least in part on the variable associated with packoff formation.

PCT9. The method of paragraph PCT8, wherein the variable associated with the initiation and/or the occurrence of packoff includes at least one of a hook load, a down-hole pressure, a surface pressure, a down-hole torque, a surface torque, a fraction of the drilling fluid stream that comprises the fluidizing stream, an average diameter of the wellbore, a diameter of a portion of the wellbore, a diameter of a portion of the wellbore that is proximal to the transition region, the first cross-sectional area, the second cross-sectional area, an orientation of the wellbore, and an orientation of a portion of the wellbore that is proximal to the transition region.

PCT10. The method of any of paragraphs PCT8-PCT9, wherein the selectively providing includes increasing a flow rate of the fluidizing stream responsive to detecting at least one of a hook load that is greater than a maximum hook load threshold, a wellbore pressure that is greater than a maximum wellbore pressure, a torque that is greater than a maximum torque, and a wellbore diameter proximal to the transition region that is greater than a maximum threshold wellbore diameter, and further wherein the selectively providing includes decreasing the flow rate of the fluidizing stream responsive to detecting at least one of a hook load that is less than a minimum hook load threshold, a wellbore pressure that is less than a minimum wellbore pressure, a torque that is less than a minimum torque, and a wellbore diameter proximal to the transition region that is less than a minimum threshold wellbore diameter.

PCT11. The method of any of paragraphs PCT8-PCT10, wherein the drilling assembly includes a fluidizing assembly that includes a plurality of fluid orifices, and further wherein the providing includes selectively providing the fluidizing stream to a selected one of the plurality of fluid orifices responsive at least in part to at least one of an orientation of the selected one of the plurality of fluid orifices and a location of the selected one of the plurality of fluid orifices with respect to a location of the portion of the cuttings bed.

PCT12. The method of paragraph PCT11, wherein the drilling assembly includes an orientation detection device configured to detect an orientation of each of the plurality of fluid orifices, wherein the method further includes detecting the orientation of each of the plurality of fluid orifices, and further wherein the method includes providing the fluidizing stream to the selected one of the plurality of fluid orifices responsive to detecting that the selected one of the plurality of fluid orifices is within a threshold distance of a bottom surface of the wellbore.

PCT13. The method of paragraph PCT11, wherein the selected one of the plurality of fluid orifices includes an orientation control assembly configured to control the orientation of the selected one of the plurality of orifices with respect to at least one of the drilling assembly, the wellbore, and the cuttings bed, and further wherein the method includes controlling the orientation of the selected one of the plurality of fluid orifices, wherein the controlling includes directing a portion of the fluidizing stream that flows through the selected one of the plurality of fluid orifices toward the cuttings bed.

PCT14. The method of any of paragraphs PCT8-PCT13, wherein the method further includes modeling the drilling assembly as it is removed from the wellbore, wherein the modeling includes calculating a target portion of the drilling fluid stream that comprises the fluidizing stream, wherein the providing includes selectively providing the fluidizing stream responsive at least in part on at least one of the modeling and the calculating, and further wherein the modeling is based at least in part on at least one of a variable associated with the wellbore, an average diameter of the wellbore, a diameter of a portion of the wellbore, a length of the wellbore, an orientation of the wellbore, a composition of a geological formation that contains the wellbore, a composition of the cuttings bed, a variable associated with the drilling assembly, a diameter of the drilling assembly, the first cross-sectional area, the second cross-sectional area, a diameter of a bottom-hole assembly associated with the drilling assembly, a cuttings bed height, a variable associated with the drilling fluid stream, a viscosity of the drilling fluid, and a variable associated with a drill rig.

PCT15. The method of any of paragraphs PCT8-PCT14, wherein the providing includes providing the fluidizing stream at a fluidizing stream pressure that is within 25% of a pressure of the drilling fluid stream within the transition region.

PCT16. A drilling assembly configured to drill a wellbore, the drilling assembly comprising:

a first section having a first cross-sectional area;

a second section having a second cross-sectional area, wherein the first cross-sectional area is less than the second cross-sectional area, and further wherein the first section is farther from a terminal end of the drilling assembly than the second section;

a transition region between the first section and the second section;

a fluidizing assembly configured to fluidize a portion of a cuttings bed proximal the transition region; and a fluid drive assembly configured to receive a wellbore fluid stream from within the wellbore and to provide the wellbore fluid stream to the fluidizing assembly, wherein the fluidizing assembly is configured to provide the wellbore fluid stream to the portion of the cuttings bed as a fluidizing stream.

PCT17. A method of removing a drilling assembly from a wellbore, wherein the drilling assembly includes a transition region between a first section including a first cross-sectional area and a second section including a second cross-sectional area, wherein the first cross-sectional area is less than the second cross-sectional area, and further wherein the first section is farther from a terminal end of the drilling assembly than the second section, the method comprising:

withdrawing at least a portion of the drilling assembly from the wellbore; detecting a variable associated with the initiation and/or the occurrence of packoff within the wellbore; and providing a fluidizing stream to a portion of a cuttings bed proximal the transition region, wherein the fluidizing stream includes a wellbore fluid stream that is received into the drilling assembly from within the wellbore, and further wherein the providing includes selectively providing the fluidizing stream based at least in part on the variable associated with the initiation and/or the occurrence of packoff.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A drill rig, comprising:

a drilling assembly configured to drill a wellbore, the drilling assembly comprising:

a first section having a first cross-sectional area;

a second section having a second cross-sectional area, wherein the first cross-sectional area is less than the second cross-sectional area, and further wherein the first section is farther from a terminal end of the drilling assembly than the second section;

a fluid conduit, wherein the first section and the second section define at least a portion of the fluid conduit, and further wherein the fluid conduit is configured to transmit a drilling fluid stream to the terminal end of the drilling assembly;

a transition region between the first section and the second section;

a fluidizing assembly configured to fluidize a portion of a cuttings bed proximal the transition region;

and a flow control assembly configured to selectively divert a portion of the drilling fluid stream to the fluidizing assembly, wherein the fluidizing assembly is configured to provide the portion of the drilling fluid stream to the portion of the cuttings bed as a fluidizing stream;

a mechanical drive assembly in mechanical communication with the drilling assembly;

a fluid supply assembly in fluid communication with the drilling assembly and configured to supply the drilling fluid stream to the drilling assembly; and a controller configured to control the operation of the drill rig;

wherein the controller is configured to increase the portion of the drilling fluid stream that is supplied to the fluidizing assembly responsive to detecting at least one of a hook load that is greater than a maximum hook load threshold, a wellbore pressure that is greater than a maximum wellbore pressure threshold, and a wellbore diameter proximal to the fluidizing assembly that is greater than a maximum threshold wellbore diameter, and further wherein the controller is configured to decrease the portion of the drilling fluid stream that is supplied to the fluidizing assembly responsive to detecting at least one of a hook load that is less than a minimum hook load threshold, a wellbore pressure that is less than a minimum wellbore pressure threshold, and a wellbore diameter proximal to the fluidizing assembly that is less than a minimum threshold wellbore diameter.

2. A method of removing a drilling assembly from a wellbore, wherein the drilling assembly includes a transition region between a first section including a first cross-sectional area and a second section including a second cross-sectional area, wherein the first cross-sectional area is less than the second cross-sectional area, wherein the first section is farther from a terminal end of the drilling assembly than the second section, and further wherein the drilling assembly includes a fluid conduit configured to transmit a drilling fluid stream, the method comprising:

withdrawing at least a portion of the drilling assembly from the wellbore;

detecting a variable associated with packoff within the wellbore; and providing a fluidizing stream to a portion of a cuttings bed proximal the transition region, wherein the fluidizing stream includes a portion of the drilling fluid stream, and further wherein the providing includes selectively providing the fluidizing stream based at least in part on the variable associated with packoff.

3. The method of claim 2, wherein the variable associated with packoff includes at least one of a hook load, a down-hole pressure, a surface pressure, a down-hole torque, a surface torque, a fraction of the drilling fluid stream that comprises the fluidizing stream, an average diameter of the wellbore, a diameter of a portion of the wellbore, a diameter of a portion of the wellbore that is proximal to the transition region, the first cross-sectional area, the second cross-sectional area, an orientation of the wellbore, and an orientation of a portion of the wellbore that is proximal to the transition region.

4. The method of claim 2, wherein the selectively providing includes controlling a flow rate of the fluidizing stream.

5. The method of claim 2, wherein the selectively providing includes selectively providing 1 to 60% of the drilling fluid stream as the fluidizing stream.

6. The method of claim 2, wherein the selectively providing includes increasing a flow rate of the fluidizing stream responsive to detecting at least one of a hook load that is greater than a maximum hook load threshold, a wellbore pressure that is greater than a maximum wellbore pressure, a torque that is greater than a maximum torque, and a wellbore diameter proximal to the transition region that is greater than a maximum threshold wellbore diameter, and further wherein the selectively providing includes decreasing the flow rate of the fluidizing stream responsive to detecting at least one of a hook load that is less than a minimum hook load threshold, a wellbore pressure that is less than a minimum wellbore pressure, and a wellbore diameter proximal to the transition region that is less than a minimum threshold wellbore diameter.

7. The method of claim 2, wherein the providing includes selectively providing the fluidizing stream based at least in part on a variable associated with the drilling assembly, wherein the variable associated with the drilling assembly includes at least one of an orientation of the drilling assembly within the wellbore, an orientation of a fluidizing assembly within the wellbore, and a distance between the transition region and the portion of the cuttings bed.

8. The method of claim 2, wherein the drilling assembly includes a fluidizing assembly that includes a plurality of fluid orifices, and further wherein the providing includes selectively providing the fluidizing stream to a selected one of the plurality of fluid orifices responsive at least in part to at least one of an orientation of the selected one of the plurality of fluid orifices and a location of the selected one of the plurality of fluid orifices with respect to a location of the portion of the cuttings bed.

9. The method of claim 8, wherein the method includes providing the fluidizing stream to the selected one of the plurality of fluid orifices responsive to the selected one of the plurality of fluid orifices being within a threshold distance of the portion of the cuttings bed.

10. The method of claim 8, wherein the drilling assembly includes an orientation detection device configured to detect an orientation of each of the plurality of fluid orifices, wherein the method further includes detecting the orientation of each of the plurality of fluid orifices, and further wherein the method includes providing the fluidizing stream to the selected one of the plurality of fluid orifices responsive to detecting that the selected one of the plurality of fluid orifices is within a threshold distance of a bottom surface of the wellbore.

11. The method of claim 8, wherein the selected one of the plurality of fluid orifices includes an orientation control assembly configured to control an orientation of the selected one of the plurality of orifices with respect to at least one of the drilling assembly, the wellbore, and the cuttings bed, and further wherein the method includes controlling the orientation of the selected one of the plurality of fluid orifices, wherein the controlling includes directing a portion of the fluidizing stream that flows through the selected one of the plurality of fluid orifices toward the cuttings bed.

12. The method of claim 8, wherein the selectively providing includes selectively providing the fluidizing stream to a base of the cuttings bed.

13. The method of claim 8, wherein at least a portion of the plurality of fluid orifices includes a diffuser.

14. The method of claim 2, wherein the method further includes modeling the drilling assembly as it is removed from the wellbore, wherein the modeling includes calculating a target portion of the drilling fluid stream that comprises the fluidizing stream, and further wherein the providing includes selectively providing the fluidizing stream responsive at least in part on at least one of the modeling and the calculating.

15. The method of claim 14, wherein the modeling is based at least in part on at least one of a variable associated with the wellbore, an average diameter of the wellbore, a diameter of a portion of the wellbore, a length of the wellbore, an orientation of the wellbore, a composition of a geological formation that contains the wellbore, a composition of the cuttings bed, a variable associated with the drilling assembly, a diameter of the drilling assembly, the first cross-sectional area, the second cross-sectional area, a diameter of a bottom-hole assembly associated with the drilling assembly, a cuttings bed height, a variable associated with the drilling fluid stream, a viscosity of the drilling fluid, and a variable associated with a drill rig.

16. The method of claim 2, wherein the method further includes injecting a packoff-inhibiting additive into the drilling fluid stream.

17. The method of claim 2, wherein the providing includes providing the fluidizing stream at a fluidizing stream pressure that is within 25% of a pressure of the drilling fluid stream within the transition region.

18. A method of removing a drilling assembly from a wellbore, wherein the drilling assembly includes a transition region between a first section including a first cross-sectional area and a second section including a second cross-sectional area, wherein the first cross-sectional area is less than the second cross-sectional area, and further wherein the first section is farther from a terminal end of the drilling assembly than the second section, the method comprising:

withdrawing at least a portion of the drilling assembly from the wellbore;

detecting a variable associated with packoff within the wellbore; and providing a fluidizing stream to a portion of a cuttings bed proximal the transition region, wherein the fluidizing stream includes a wellbore fluid stream that is received into the drilling assembly from within the wellbore, and further wherein the providing includes selectively providing the fluidizing stream based at least in part on the variable associated with packoff.

* * * * *